US011217191B2

(12) United States Patent
Mitsuzawa

(10) Patent No.: US 11,217,191 B2
(45) Date of Patent: Jan. 4, 2022

(54) DISPLAY DEVICE

(71) Applicant: Japan Display Inc., Tokyo (JP)

(72) Inventor: Yutaka Mitsuzawa, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 17/175,053

(22) Filed: Feb. 12, 2021

(65) Prior Publication Data

US 2021/0210030 A1 Jul. 8, 2021

Related U.S. Application Data

(63) Continuation of application No. 16/298,581, filed on Mar. 11, 2019, now Pat. No. 10,950,192.

(30) Foreign Application Priority Data

Mar. 15, 2018 (JP) ..... JP2018-048494

(51) Int. Cl.
*G09G 3/36* (2006.01)

(52) U.S. Cl.
CPC ..... *G09G 3/364* (2013.01); *G09G 3/3607* (2013.01); *G09G 3/3614* (2013.01); *G09G 2300/0452* (2013.01); *G09G 2300/0842* (2013.01); *G09G 2310/08* (2013.01)

(58) Field of Classification Search
CPC .... G09G 3/364; G09G 3/3607; G09G 3/3614; G09G 2300/042; G09G 200/0842; G09G 2310/08
See application file for complete search history.

(56) References Cited

U.S. PATENT DOCUMENTS

| | | | |
|---|---|---|---|
| 5,945,972 | A | 8/1999 | Okumura et al. |
| 7,151,511 | B2 | 12/2006 | Koyama |
| 2003/0234755 | A1 | 12/2003 | Koyama |
| 2007/0063959 | A1 | 3/2007 | Iwabuchi et al. |

FOREIGN PATENT DOCUMENTS

| | | | |
|---|---|---|---|
| JP | H09-212140 | A | 8/1997 |

*Primary Examiner* — Lixi C Simpson
(74) *Attorney, Agent, or Firm* — K&L Gates LLP

(57) ABSTRACT

According to an aspect, a display device includes: a plurality of sub-pixels, each sub-pixel including at least one memory; a setting circuit configured to select either a first mode in which a still image is displayed or a second mode in which a moving image is displayed; and a switching circuit configured to switch coupling between the sub-pixels and the memories according to the selection made by the setting circuit. The first mode is a mode in which each of the sub-pixels is coupled to one of the at least one memory included in the sub-pixel, and the second mode is a mode including a time period in which at least one of the sub-pixels is coupled to the at least one memory included in another of the sub-pixels.

12 Claims, 27 Drawing Sheets

STILL IMAGE MODE

DISPLAY DEVICE

CROSS-REFERENCE TO RELATED APPLICATIONS

This application is a Continuation Application of U.S. patent application Ser. No. 16/298,581 filed on Mar. 11, 2019, which claims priority from Japanese Application No. 2018-48494, filed on Mar. 15, 2018, the contents of which are incorporated by reference herein in its entirety.

BACKGROUND

1. Technical Field

The present disclosure relates to a display device.

2. Description of the Related Art

A display device for displaying images includes a plurality of pixels. Japanese Patent Application Laid-open Publication No. 9-212140 (JP-A-9-212140) describes what is called a memory-in-pixel (MIP) display device in which a plurality of pixels each include memories. In the display device described in JP-A-9-212140, each of the pixels includes the memories and a switching circuit for switching between the memories.

Each of the pixels in the display device described in JP-A-9-212140 needs to be provided with memories the number of which corresponds to the number of frames of a moving image. Thus, in the display device that displays moving images, the pixel area increases with the number of memories. In other words, the display device that displays moving images is difficult to have a higher definition. However, a display device that displays still images is required to have pixels the number of which is sufficient for performing display at a higher definition. As a result, when conventional display devices are used to display both moving images and still images, the memories are insufficient in number to provide frames required for displaying a moving image, and/or the resolution of images is insufficient.

For the foregoing reasons, there is a need for a display device capable of displaying a moving image having frames the number of which exceeds the number of memories provided in each pixel and a still image having a higher definition than that of the moving image.

SUMMARY

According to an aspect, a display device includes: a plurality of sub-pixels, each sub-pixel including at least one memory; a setting circuit configured to select either a first mode in which a still image is displayed or a second mode in which a moving image is displayed; and a switching circuit configured to switch coupling between the sub-pixels and the memories according to the selection made by the setting circuit. The first mode is a mode in which each of the sub-pixels is coupled to one of the at least one memory included in the sub-pixel, and the second mode is a mode including a time period in which at least one of the sub-pixels is coupled to the at least one memory included in another of the sub-pixels.

DETAILED DESCRIPTION

Figure 1:
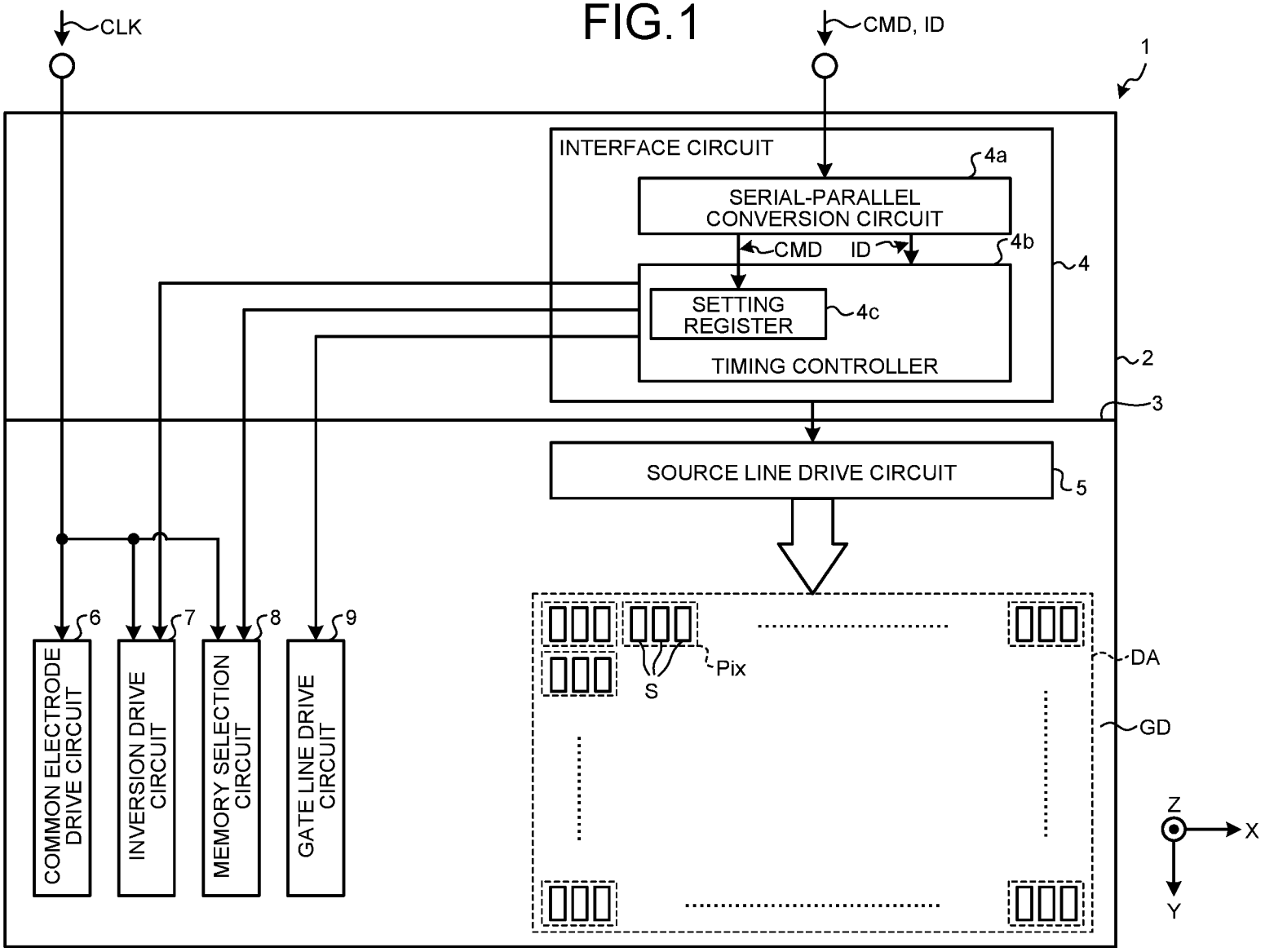
FIG. 1 is a diagram illustrating an overview of an overall configuration of a display device according to a first embodiment.

The following describes modes (embodiments) for carrying out the present invention in detail with reference to the drawings. The present invention is not limited to the description of the embodiments given below. Components described below include those easily conceivable by those skilled in the art or those substantially identical thereto. Furthermore, the components described below can be combined as appropriate. What is disclosed herein is merely an example, and the present invention naturally encompasses appropriate modifications easily conceivable by those skilled in the art while maintaining the gist of the invention. To further clarify the description, widths, thicknesses, shapes, and the like of various parts will be schematically illustrated in the drawings as compared with actual aspects thereof, in some cases. However, they are merely examples, and interpretation of the present invention is not limited thereto. The same element as that illustrated in a drawing that has already been discussed is denoted by the same reference numeral through the description and the drawings, and detailed description thereof will not be repeated in some cases where appropriate.

In this disclosure, when an element is described as being "on" another element, the element can be directly on the other element, or there can be one or more elements between the element and the other element.

First Embodiment

FIG. 1 is a diagram illustrating an overview of an overall configuration of a display device 1 according to a first embodiment. The display device 1 includes a first panel 2 and a second panel 3 disposed so as to be opposed to the first panel 2. The display device 1 has a display area DA in which an image is displayed and a frame area GD outside the display area DA. In the display area DA, a liquid crystal layer 30 (refer to FIG. 2) is sealed between the first panel 2 and the second panel 3.

In the first embodiment, the display device 1 is a liquid crystal display device using the liquid crystal layer 30. However, the present disclosure is not limited thereto. The display device 1 may be an organic electroluminescent (EL) display device using organic EL elements instead of the liquid crystal layer 30.

In the display area DA, a plurality of pixels Pix are arranged in a matrix (row-column configuration) of H columns (where H is a natural number) arranged in an X-direction and V rows (where V is a natural number) arranged in a Y-direction. The X-direction is parallel to principal surfaces of the first panel 2 and the second panel 3, and the Y-direction is parallel to the principal surfaces of the first panel 2 and the second panel 3 and intersects the X-direction. An interface circuit 4, a source line drive circuit 5, a common electrode drive circuit 6, an inversion drive circuit 7, a memory selection circuit 8, and a gate line drive circuit 9 are disposed in the frame area GD. A configuration can be employed in which, of these circuits, the interface circuit 4, the source line drive circuit 5, the common electrode drive circuit 6, the inversion drive circuit 7, and the memory selection circuit 8 are built into an integrated circuit (IC) chip, and the gate line drive circuit 9 is provided on the first panel. Alternatively, a configuration can be employed in which the group of the circuits built into the IC chip is provided in a processor outside the display device, and the circuits are coupled to the display device 1. Unless otherwise stated, the term "coupled" used below refers to "electrically coupled" through, for example, wiring and/or switches.

Each of the V×H pixels Pix includes a plurality of sub-pixels S. In the first embodiment, the sub-pixels S are three sub-pixels: red (R), green (G), and blue (B), but the present disclosure is not limited thereto. The sub-pixels S may be four sub-pixels: red (R), green (G), blue (B), and white (W). Alternatively, the sub-pixels S may be five or more sub-pixels of different colors.

In the first embodiment, each of the pixels Pix includes the three sub-pixels S. Accordingly, V×H×3 sub-pixels S are arranged in the display area DA. Each of the sub-pixels S includes a memory or memories. In the first embodiment, each of the sub-pixels S includes one memory. Accordingly, V×H×3×1 memories are arranged in the display area DA. The number of the memories included in each of the sub-pixels S is not limited to one, and may be two or more.

The interface circuit 4 includes a serial-parallel conversion circuit 4*a* and a timing controller 4*b*. The timing controller 4*b* includes a setting register 4*c*. The serial-parallel conversion circuit 4*a* is serially supplied with command data CMD and image data ID from an external circuit. Examples of the external circuit include a host central processing unit (CPU) and an application processor, but the present disclosure is not limited thereto.

The serial-parallel conversion circuit 4*a* converts the supplied command data CMD into parallel data, and outputs the parallel data to the setting register 4*c*. Values for controlling the source line drive circuit 5, the inversion drive circuit 7, the memory selection circuit 8, and the gate line drive circuit 9 are set in the setting register 4*c* based on the command data CMD.

The values that are set in the setting register 4*c* include a value indicating whether the display device 1 is to operate in a first mode or a second mode. The first mode is a mode for displaying a still image. The second mode is a mode for displaying a moving image. The setting register 4*c* of the first embodiment serves as a setting circuit capable of selecting either the first mode or the second mode.

The serial-parallel conversion circuit 4*a* converts the supplied image data ID into parallel data, and outputs the parallel data to the timing controller 4*b*. The timing controller 4*b* outputs the image data ID to the source line drive circuit 5 based on the values set in the setting register 4*c*. The timing controller 4*b* also controls the inversion drive circuit 7, the memory selection circuit 8, and the gate line drive circuit 9 based on the values set in the setting register 4*c*.

The common electrode drive circuit 6, the inversion drive circuit 7, and the memory selection circuit 8 are supplied with a reference clock signal CLK from an external circuit. Examples of the external circuit include a clock generator, but the present disclosure is not limited thereto.

Driving methods such as a common inversion driving method, a column inversion driving method, a line inversion driving method, a dot inversion driving method, and a frame inversion driving method are known as driving methods for restraining a screen of the liquid crystal display device from burning in.

The display device 1 can employ any one the above-mentioned driving methods. In the first embodiment, the display device 1 employs the common inversion driving method. Since the display device 1 employs the common inversion driving method, the common electrode drive circuit 6 inverts the potential (common potential VCOM) of a common electrode in synchronization with the reference clock signal CLK. The inversion drive circuit 7 inverts the potential of a sub-pixel electrode in synchronization with the reference clock signal CLK under the control of the timing controller 4*b*. Thus, the display device 1 can implement the common inversion driving method. In the first embodiment, the display device 1 is what is called a normally black liquid crystal display device that displays a black color when no voltage is applied to a liquid crystal LQ (refer to FIG. 7) and displays a white color when a voltage is applied to the liquid crystal LQ. The normally black liquid crystal display device displays the black color when the potential of the sub-pixel electrode is in phase with the common potential VCOM, and displays the white color when the potential of the sub-pixel electrode is out of phase with the common potential VCOM. A normally white configuration can instead be employed in which the white color is displayed when the potential of the sub-pixel electrode is in phase with the common potential VCOM, and the black color is displayed when the potential of the sub-pixel electrode is out of phase with the common potential VCOM.

To display the image on the display device 1, sub-pixel data needs to be stored in the memory of each of the sub-pixels S. To store the sub-pixel data in each of the memories, the gate line drive circuit 9 outputs a gate signal for selecting one row of the V×H pixels Pix under the control of the timing controller 4*b*.

The number of the gate lines (for example, a gate line $GCL_1$, and so on) that couple the gate line drive circuit 9 to the pixels Pix corresponds to the number of memories included in each of the sub-pixels S. Under the control of the timing controller 4*b*, the gate line drive circuit 9 sequentially outputs the gate signal for selecting one of the V rows.

Under the control of the timing controller 4*b*, the source line drive circuit 5 outputs the sub-pixel data to each of the memories selected by the gate signal. Through this process, the sub-pixel data is sequentially stored in the memory of each of the sub-pixels.

Gradation control (for example, orientation control of liquid crystal molecules) of each of the sub-pixels S is performed based on the sub-pixel data stored in memories. Each of the sub-pixels S is configured to be coupled to memories other than the memory included in the sub-pixel S, in addition to this memory.

When a moving image is displayed, the memory selection circuit 8 sequentially switches the memory being coupled to the sub-pixel S according to the timing of switching between frame images. In the first embodiment, one sub-pixel S is configured to be coupled to four memories. In other words, in the first embodiment, the memory selection circuit 8 switches between the memories, so that the moving image display can be performed with four-frame images. Each sub-pixel is not limited to be configured to be coupled to four memories, and only needs to be configured to be coupled to two or more memories. The control operation of the coupling of the memories will be described later in detail.

Figure 2:
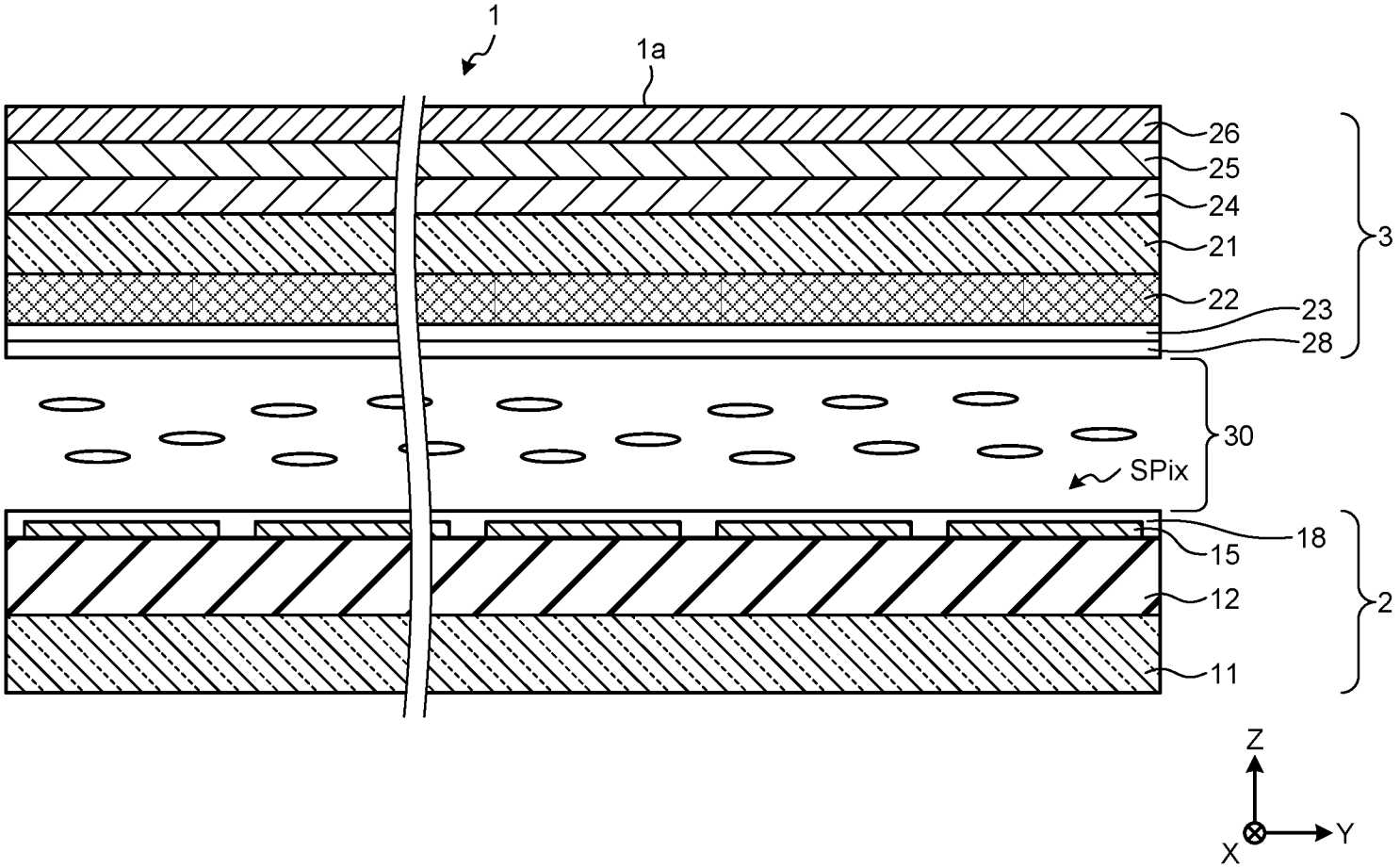
FIG. 2 is a sectional view of the display device according to the first embodiment.

FIG. 2 is a sectional view of the display device 1 according to the first embodiment. As illustrated in FIG. 2, the display device 1 includes the first panel 2, the second panel 3, and the liquid crystal layer 30. The second panel 3 is disposed so as to be opposed to the first panel 2. The liquid crystal layer 30 is provided between the first panel 2 and the second panel 3. A surface that is one principal surface of the second panel 3 serves as a display surface 1*a* for displaying the image.

Light incident from outside the display surface 1*a* is reflected by a reflective electrode 15 of the first panel 2 to exit from the display surface 1*a*. The display device 1 of the first embodiment is a reflective liquid crystal display device that uses this reflected light to display the image on the display surface 1*a*. In this specification, a direction parallel to the display surface 1*a* corresponds to the X-direction, and a direction intersecting the X-direction in a plane parallel to the display surface 1*a* corresponds to the Y-direction. A direction orthogonal to the display surface 1*a* corresponds to a Z-direction.

The first panel 2 includes a first substrate 11, an insulating layer 12, the reflective electrode 15, and an orientation film 18. Examples of the first substrate 11 include a glass substrate and a resin substrate. A surface of the first substrate 11 is provided with circuit elements and various types of wiring, such as the gate lines (for example, the gate line $GCL_1$, and so on) and data lines, which are not illustrated. The circuit elements include switching elements, such as thin-film transistors (TFTs), and capacitive elements.

The insulating layer 12 is provided on the first substrate 11 and planarizes surfaces of, for example, the circuit elements and the various types of wiring as a whole. A plurality of reflective electrodes 15 are provided on the insulating layer 12. The orientation film 18 is provided between the reflective electrodes 15 and the liquid crystal layer 30. The reflective electrodes 15 are provided in rectangular shapes, one for each of the sub-pixels S. The reflective electrodes 15 are made of a metal, such as aluminum (Al) or silver (Ag). The reflective electrodes 15 may have a configuration stacked with these metal materials and a light-transmitting conductive material, such as indium tin oxide (ITO). The reflective electrodes 15 are made using a material having good reflectance, and serve as reflective plates that diffusely reflect the light incident from the outside.

The light reflected by the reflective electrode 15 travels in a uniform direction toward the display surface 1*a* side, although the light is scattered by the diffuse reflection. A change in level of a voltage applied to the reflective electrode 15 changes the transmission state of the light in the liquid crystal layer 30 on the upper side of the reflective electrodes, that is, the transmission state of the light of each of the sub-pixels. In other words, the reflective electrode 15 also has a function as the sub-pixel electrode.

The second panel 3 includes a second substrate 21, a color filter 22, a common electrode 23, an orientation film 28, a ¼ wavelength plate 24, a ½ wavelength plate 25, and a polarizing plate 26. One of the surfaces of the second substrate 21 that is opposed to the first panel 2 is provided with the color filter 22 and the common electrode 23 in this order. The orientation film 28 is provided between the common electrode 23 and the liquid crystal layer 30. The other surface of the second substrate 21 that is opposed to the display surface 1*a* is provided with the ¼ wavelength plate 24, the ½ wavelength plate 25, and the polarizing plate 26 stacked in this order.

Examples of the second substrate 21 include a glass substrate and a resin substrate. The common electrode 23 is made of a light-transmitting conductive material, such as ITO. The common electrode 23 is disposed so as to be opposed to the reflective electrodes 15, and supplies a common potential to each of the sub-pixels S. The color filter 22 includes filters having, for example, three colors of red (R), green (G), and blue (B), but the present disclosure is not limited to this example.

The liquid crystal layer 30 includes, for example, nematic liquid crystals. A change in level of a voltage between the common electrode 23 and the reflective electrode 15 changes the orientation state of liquid crystal molecules in the liquid crystal layer 30. Through this process, the light passing through the liquid crystal layer 30 is modulated on a per sub-pixel S basis.

For example, external light is incident from outside the display surface 1*a* of the display device 1, and the incident light reaches the reflective electrodes 15 through the second panel 3 and the liquid crystal layer 30. The incident light is reflected on the reflective electrodes 15 of the pixels S. The reflected light is modulated on a per sub-pixel S basis, and emitted from the display surface 1*a*. Through this process, the image is displayed.

Figure 3:
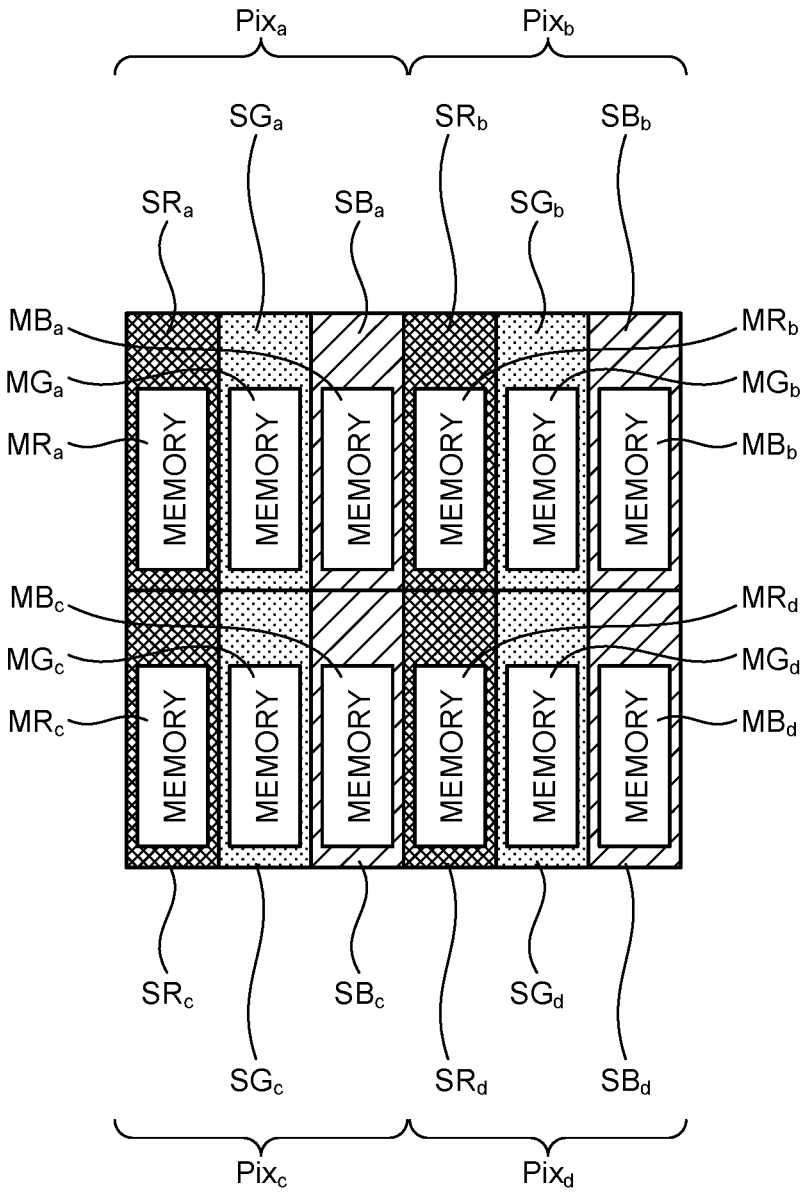
FIG. 3 is a schematic diagram illustrating an example of sub-pixels included in 2×2 pixels and memories included in these sub-pixels in the first embodiment.

FIG. 3 is a schematic diagram illustrating an example of the sub-pixels S included in 2×2 pixels Pix and memories M included in these sub-pixels S in the first embodiment. In the explanation of the first embodiment made using FIG. 3 and other figures, subscript alphabets are added to distinguish the pixels Pix and the sub-pixels S arranged in the area provided with the 2×2 pixels Pix. Specifically, the pixels Pix are distinguished as, for example, a pixel $Pix_a$, a pixel $Pix_b$, a pixel $Pix_c$, and a pixel $Pix_d$. The pixel $Pix_a$ and the pixel $Pix_b$ are located in the same row. The pixel $Pix_c$ and the pixel $Pix_d$ are located in the same row. The pixel $Pix_a$ and the pixel $Pix_c$ are located in the same column. The pixel $Pix_b$ and the pixel $Pix_d$ are located in the same column.

With reference to FIG. 3 and FIGS. 14, 19, and 21 to be described later, the configuration of each of the pixels Pix will be described by exemplifying the pixel $Pix_a$. The pixels $Pix_b$, $Pix_c$, and $Pix_d$ have the same configuration as that of the pixel $Pix_a$. The subscript "a" can be replaced with another letter (b, c, or d) to give a description of the configuration of each of the other pixels Pix.

The pixel $Pix_a$ includes a red (R) sub-pixel $SR_a$ (first sub-pixel), a green (G) sub-pixel $SG_a$, and a blue (B) sub-pixel $SB_a$. The sub-pixels $SR_a$, $SG_a$, and $SB_a$ are arranged in the X-direction. Each of the sub-pixels $SR_a$, $SG_a$, and $SB_a$ is referred to as a sub-pixel $S_a$ when these colors are not particularly distinguished, and is referred to as a sub-pixel S when no distinction is made as to which of the pixels $Pix_a$, $Pix_b$, $Pix_c$, or $Pix_d$ includes the sub-pixel S.

The pixel $Pix_b$ includes a red (R) sub-pixel $SR_b$ (second sub-pixel), a green (G) sub-pixel $SG_b$, and a blue (B) sub-pixel $SB_b$.

The red (R) sub-pixel $SR_a$ includes a memory $MR_a$ (first memory). The green (G) sub-pixel $SG_a$ includes a memory $MG_a$. The blue (B) sub-pixel $SB_a$ includes a memory $MB_a$. As illustrated, for example, in FIG. 3, one memory is disposed in one sub-pixel S in the first embodiment. Each of the memories $MR_a$, $MG_a$, and $MB_a$ is referred to as a memory $M_a$ when not distinguished from one another, and is referred to as a memory M when no distinction is made as to which of the pixels $Pix_a$, $Pix_b$, $Pix_c$, or $Pix_d$ includes the memory M. The memory M included in a red (R) sub-pixel SR (for example, memory $MR_a$, $MR_b$, $MR_c$, or $MR_a$) is collectively referred to as a memory MR in some cases. The memory M included in a green (G) sub-pixel SG (for example, memory $MG_a$, $MG_b$, $MG_c$, or $MG_d$) is collectively referred to as a memory MG in some cases. The memory M included in a blue (B) sub-pixel SB (for example, memory $MB_a$, $MB_b$, $MB_c$, or $MT_d$) is collectively referred to as a memory MB in some cases.

In the same manner, the red (R) sub-pixel $SR_b$ includes the memory $MR_b$ (second memory). The green (G) sub-pixel $SG_b$ includes the memory $MG_b$. The blue (B) sub-pixel $SB_b$ includes the memory $MB_b$.

The memory M is, for example, a memory cell that stores therein one-bit data, but the present disclosure is not limited to this example. The memory M may be a memory cell that stores therein data of two or more bits.

Figure 4:
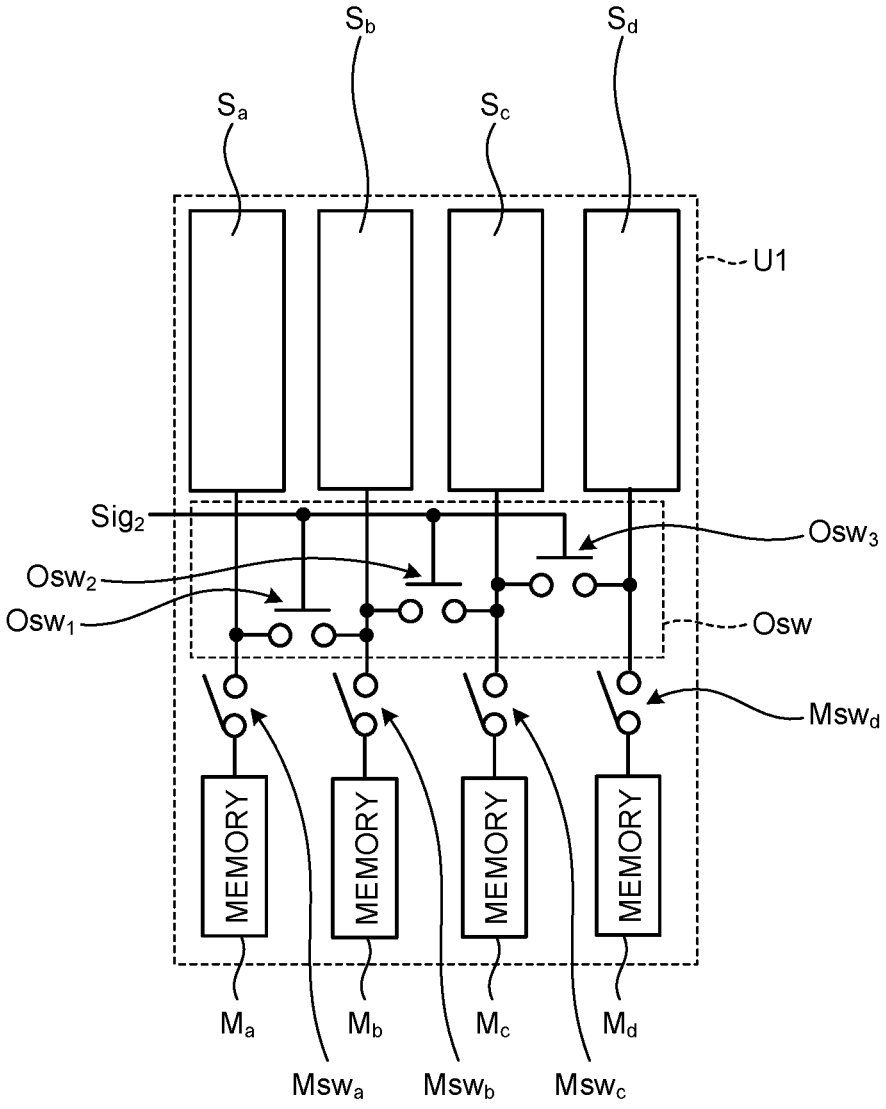
FIG. 4 is a schematic diagram of a circuit including four sub-pixels and four memories in the first embodiment.

FIG. 4 is a schematic diagram of a circuit U1 including the four sub-pixels S and the four memories M in the first embodiment. The sub-pixel $S_a$ (first sub-pixel), a sub-pixel $S_b$ (second sub-pixel), a sub-pixel $S_c$, and a sub-pixel $S_d$ illustrated in FIG. 4 are the sub-pixels S of the same color. These sub-pixels S are configured to be coupled, through a switching unit Osw, to one common memory M of the memories M included in these sub-pixels S.

As will be described later, each of the sub-pixels includes the sub-pixel electrode. Specifically, the red (R) sub-pixel $SR_a$ of the first pixel $Pix_a$ (first sub-pixel) includes the first sub-pixel electrode functioning as a reflective electrode 15. The red (R) sub-pixel $SR_b$ of the second pixel $Pix_b$ (second sub-pixel) includes the second sub-pixel electrode functioning as another reflective electrode 15. The same configuration applies to the other sub-pixels. In this regard, in FIGS. 3 to 6, the sub-pixel virtually represents the sub-pixel electrode. Also in other drawings, for the sake of convenience, the sub-pixel electrode is explained as the sub-pixel when the sub-pixel can be deemed to be the same as the sub-pixel electrode.

Figure 5:
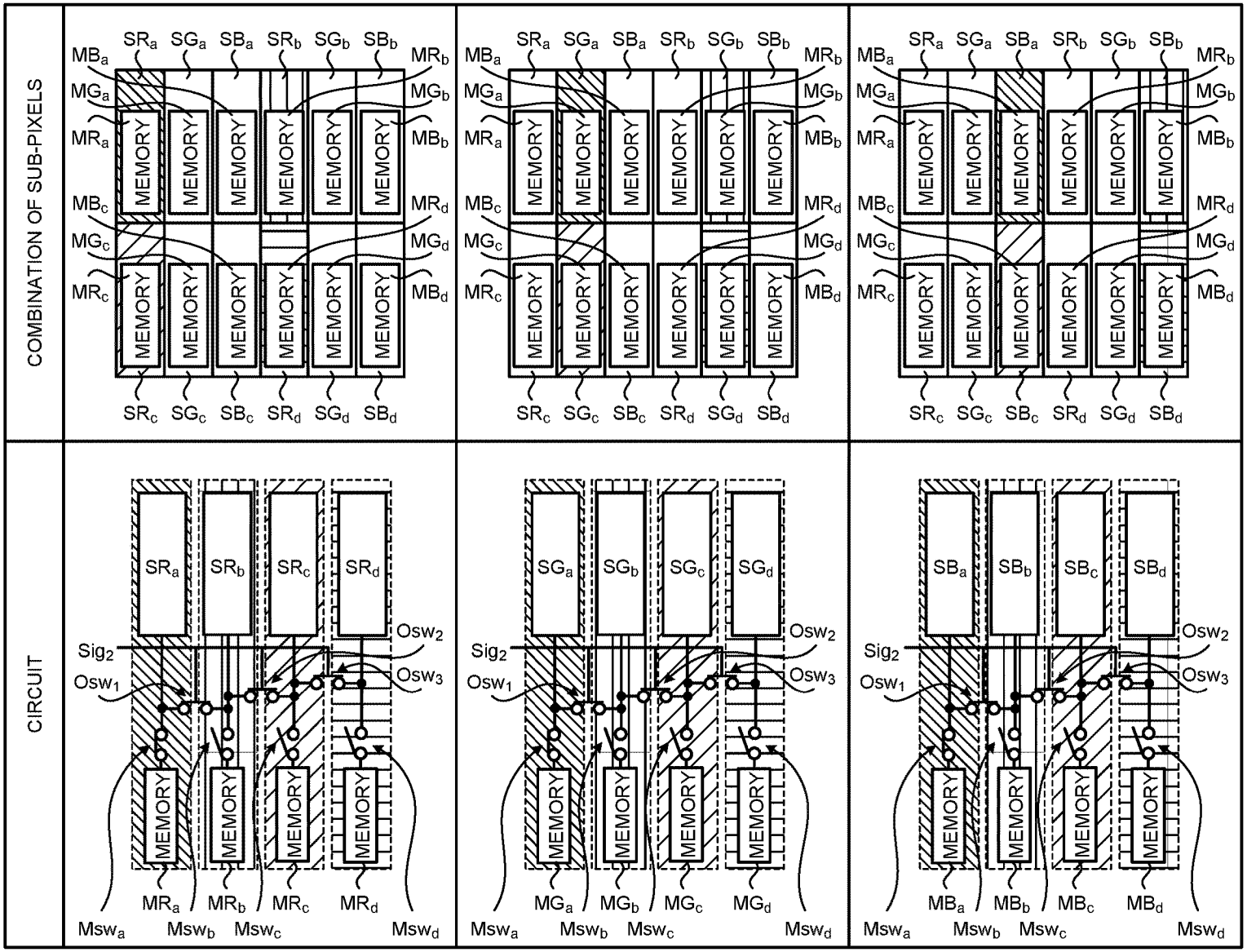
FIG. 5 is a diagram illustrating exemplary combinations of the sub-pixels included in the circuit illustrated in FIG. 4.

FIG. 5 is a diagram illustrating exemplary combinations of the sub-pixels included in the circuit U1 illustrated in FIG. 4. Taking red (R) as an example out of the colors of the sub-pixels S, the sub-pixels $SR_a$, $SR_b$, $SR_c$, and $SR_d$ are configured to be coupled, through the switching unit Osw, to any one of the memories $MR_a$, $MR_b$, $MR_c$, and $MR_d$. This applies not only to red (R) but also to the other colors (for example, green (G) and blue (B)).

The switching unit Osw is coupled to the four sub-pixels S and the four memories M. The switching unit Osw switches between coupling and uncoupling of wiring between the four sub-pixels S. The switching unit Osw opens and closes paths for coupling the sub-pixels (for example, the four sub-pixels $S_a$, $S_b$, $S_c$, and $S_d$) to one of the memories M. Specifically, the switching unit Osw includes, for example, a switch $Osw_1$, a switch $Osw_2$, and a switch $Osw_3$. The switch $Osw_1$ opens and closes the wiring between the sub-pixels $S_a$ and $S_b$. The switch $Osw_2$ opens and closes the wiring between the sub-pixels $S_b$ and $S_c$. The switch $Osw_3$ opens and closes the wiring between the sub-pixels $S_c$ and $S_d$. The switching unit Osw only needs to be capable of switching between a coupling state in which the sub-pixels (for example, the four sub-pixels $S_a$, $S_b$, $S_c$, and $S_d$) are coupled to one of the memories M, and a coupling state in which the sub-pixels are respectively coupled to the memories M different from one another. In other words, the specific configuration of the switching unit Osw may be that including, for example, the switches $Osw_1$, $Osw_2$, and $Osw_3$, or may be another configuration (refer to FIG. 12). The switching unit Osw is configured to be coupled to the four memories M through their respective switches. Specifically, the switching unit Osw is configured to be coupled to the memory $M_a$, a memory $M_b$, a memory $M_c$, and a memory $M_d$ through a switch $Msw_a$, a switch $Msw_b$, a switch $Msw_c$, and a switch $Msw_d$, respectively. The switch $Msw_a$ (first switch) opens and closes wiring between the sub-pixel $S_a$ and the memory $M_a$. The switch $Msw_b$ (second switch) opens and closes wiring between the sub-pixel $S_b$ and the memory $M_b$. The switch $Msw_c$ opens and closes wiring between the sub-pixel $S_c$ and the memory $M_c$. The switch $Msw_d$ opens and closes wiring between the sub-pixel $S_d$ and the memory $M_d$. In this manner, the switches (for example, the four switches $Msw_a$, $Msw_b$, $Msw_c$, and $Msw_d$) individually open and close the paths between these sub-pixels (for example, the four sub-pixels $S_a$, $S_b$, $S_c$, and $S_d$) and the memories (memories $M_a$, $M_b$, $M_c$, and $M_d$) provided in the respective sub-pixels. The switching unit Osw is interposed between these sub-pixels and the switches.

Figure 6:
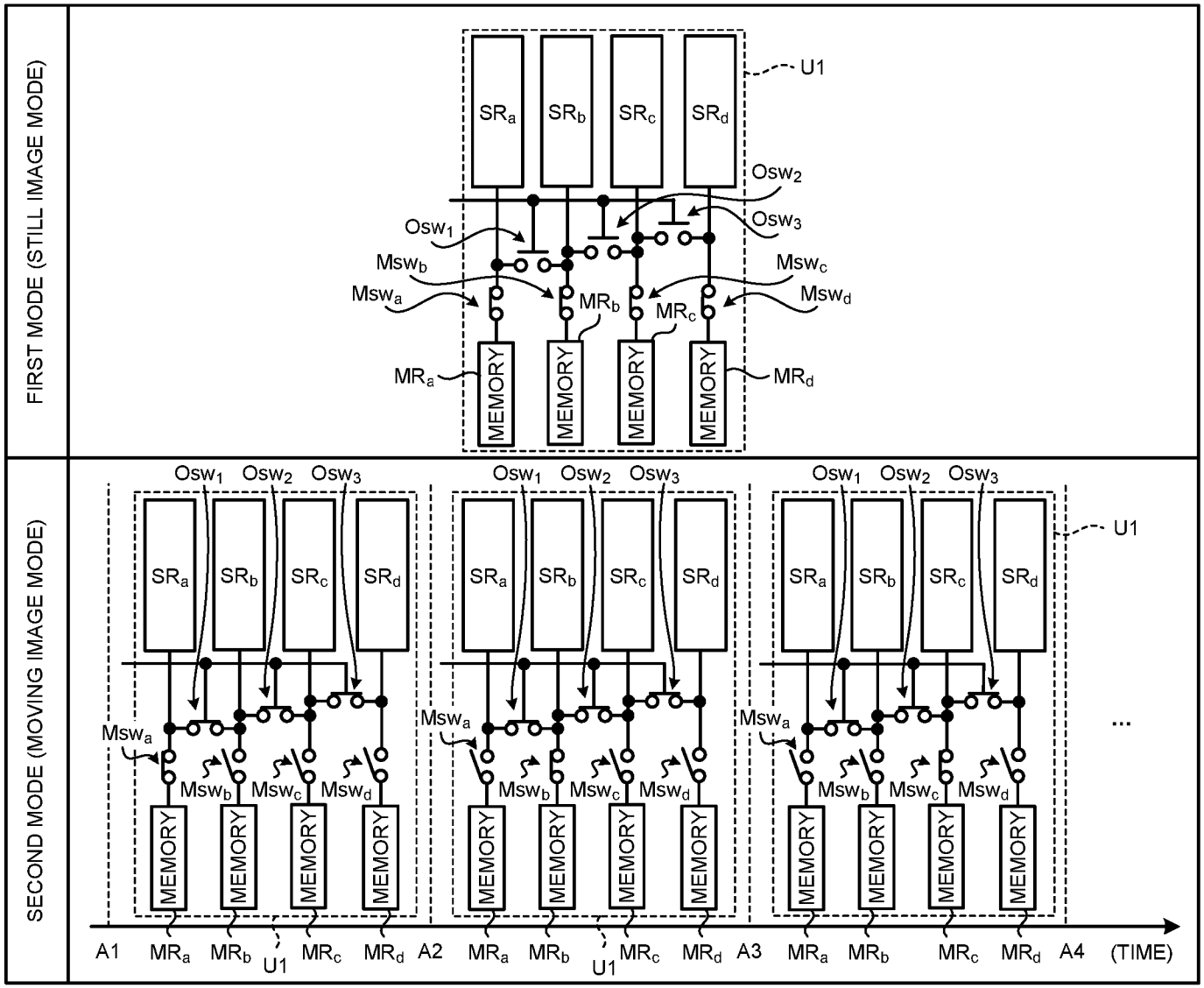
FIG. 6 is a schematic diagram illustrating exemplary coupling configurations in the circuit that differ between a first mode and a second mode in the first embodiment.

FIG. 6 is a schematic diagram illustrating exemplary coupling configurations in the circuit U1 that differ between the first mode and the second mode in the first embodiment. The first mode is a mode in which a still image is displayed. The second mode is a mode in which a moving image is displayed. In the description with reference to FIGS. 6 to 9 and FIG. 12, the sub-pixel SR (sub-pixel $SR_a$, $SR_b$, $SR_c$, or $SR_d$) and the memory MR (memory $MR_a$, $MR_b$, $MR_c$, or $MR_d$) can be replaced with the sub-pixel SG and the memory MG, or with the sub-pixel SB and the memory MB. The replacement changes the description of the sub-pixel SR and the memory MR to that of the sub-pixel SG and the memory MG, or the sub-pixel SB and the memory MB.

In the first mode, the switches $Osw_1$, $Osw_2$, and $Osw_3$ are opened to be in an uncoupled state, and the switches $Msw_a$, $Msw_b$, $Msw_c$, and $Msw_d$ are closed to be in a coupled state. As a result, the sub-pixel $SR_a$, the sub-pixel $SR_b$, the sub-pixel $SR_c$, and the sub-pixel $SR_d$ are coupled to the memory $MR_a$, the memory $MR_b$, the memory $MR_c$, and the memory $MR_d$, respectively. In the first mode, each sub-pixel SR is subjected to gradation control according to the sub-pixel data being stored in a corresponding one of the memories MR individually coupled thereto.

In the second mode, the switches $Osw_1$, $Osw_2$, and $Osw_3$ are closed to be in a coupled state. Any one of the switches $Msw_a$, $Msw_b$, $Msw_c$, and $Msw_d$ (for example, the first switch) is closed to be in a coupled state, and the other three thereof (for example, the other switches including the second switch) are opened to be in an uncoupled state. As a result, the four sub-pixels SR: the sub-pixel $SR_a$, the sub-pixel $SR_b$, the sub-pixel $SR_c$, and the sub-pixel $SR_d$, are coupled to any one of the four memories MR: the memory $MR_a$, the memory $MR_b$, the memory $MR_c$, and the memory $MR_d$. For example, the four sub-pixels SR: the sub-pixel (first sub-pixel electrode) $SR_a$, the sub-pixel (second sub-pixel electrode) $SR_b$, the sub-pixel $SR_c$, and the sub-pixel $SR_d$, are coupled to the memory (first memory) $MR_a$. In the second mode, the memory being coupled to the four sub-pixels SR is changed according to the timing of switching between the frame images of a moving image. In FIG. 6, the switch $Msw_a$ is closed in a time period of time A1 to A2 in the open/close control of the switches $Msw_a$, $Msw_b$, $Msw_c$, and $Msw_d$. Accordingly, in the time period of time A1 to A2, the four sub-pixels SR are subjected to the gradation control according to the sub-pixel data being stored in the memory $MR_a$. Only the switch $Msw_b$ is closed in a time period of time A2 to A3, and only the switch $Msw_c$ is closed between times A3 and A4. Although not illustrated, only the switch $Msw_d$ is closed after time A4. The four sub-pixels SR are subjected to the gradation control according to the sub-pixel data being stored in one of the memories MR being coupled thereto in each of the time periods. In this manner, the second mode includes the time periods in each of which some of the sub-pixels SR are coupled to a memory MR provided in another of the sub-pixels SR. In the second mode, the switching unit Osw couples the sub-pixels to one of the memories. In this case, one of the switches (for example, the four switches $Msw_a$, $Msw_b$, $Msw_c$, and $Msw_d$) closes the path between the sub-pixels and the memory M.

In the second mode, a predetermined number (for example, four included in the 2×2 pixels Pix) of the sub-pixels SR are controlled in gradation using the sub-pixel data being stored in the same memory MR. Therefore, the predetermined number of the sub-pixels SR have the same gradation. In contrast, in the first mode, the predetermined number of the sub-pixels SR are controlled in gradation using the individual sub-pixel data. Accordingly, the first mode also serves as a mode capable of achieving a resolution the predetermined number of times higher than that of the second mode.

The predetermined number is not limited to four and only needs to be two or greater. In the second mode, the positional relation of the sub-pixels SR using the same sub-pixel data is not limited to that included in the 2×2 pixels Pix, and can be changed as appropriate.

Figure 7:
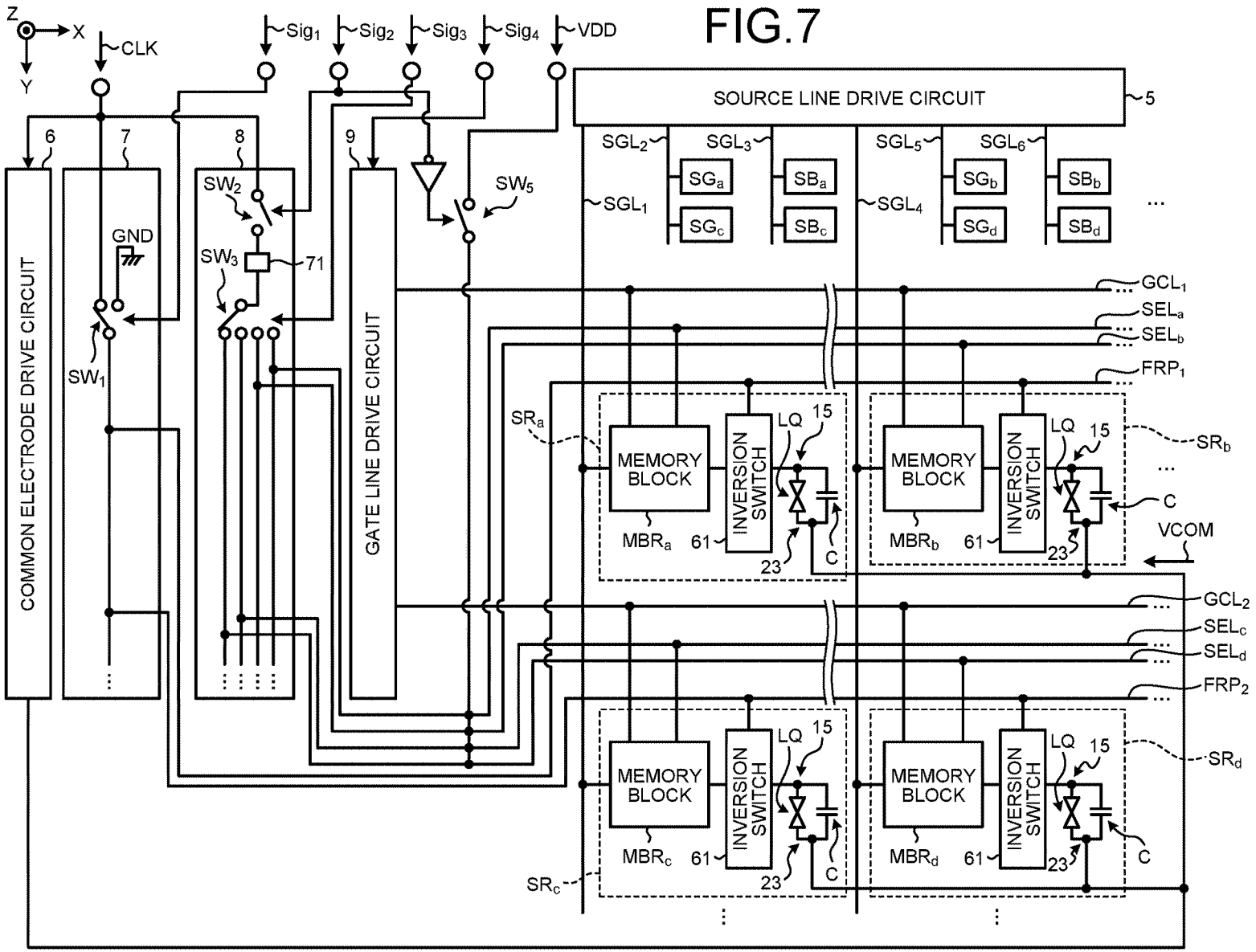
FIG. 7 is a diagram illustrating a circuit configuration of the display device according to the first embodiment.
Figure 8:
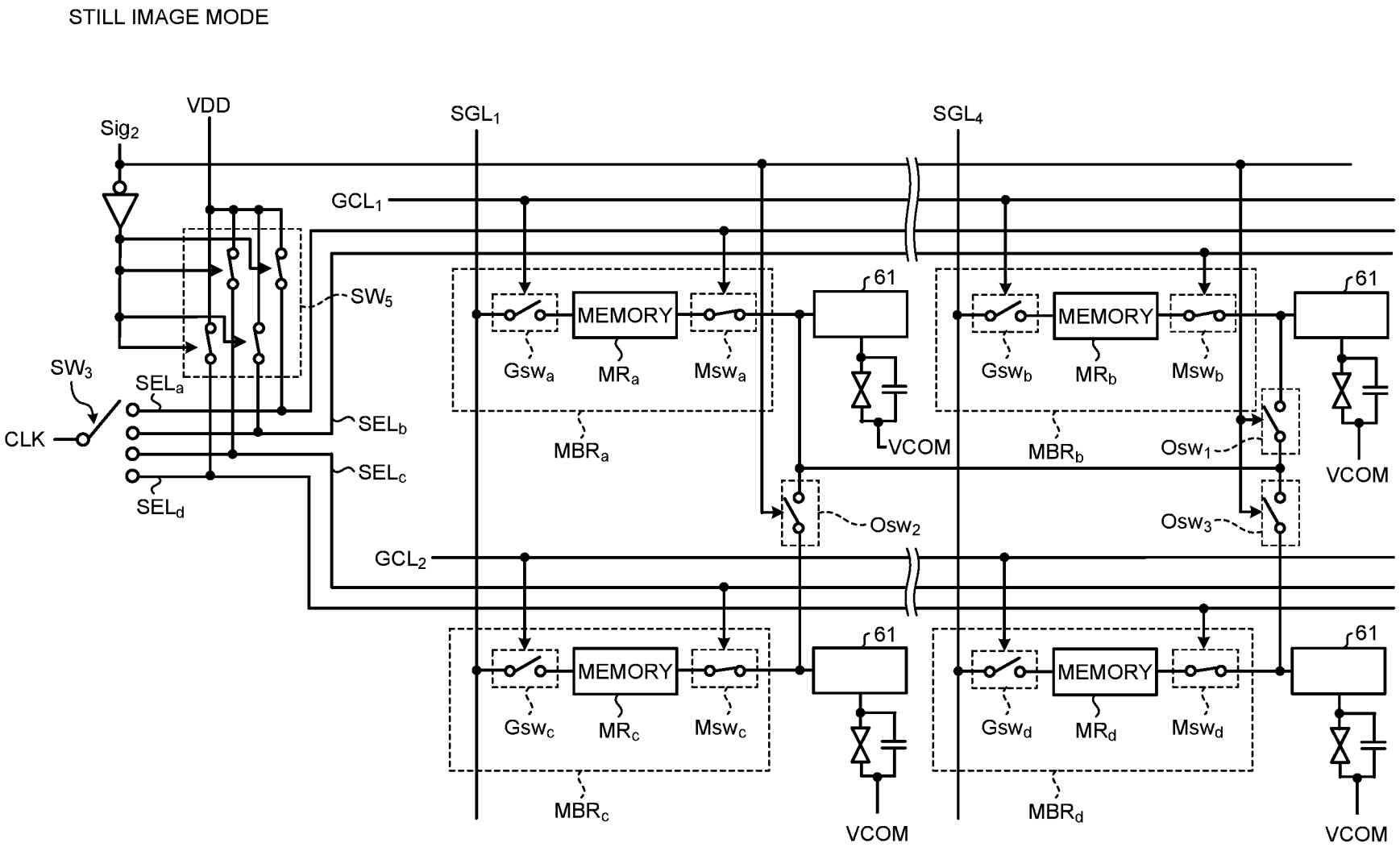
FIG. 8 is a diagram illustrating the circuit configuration of the display device according to the first embodiment.
Figure 9:
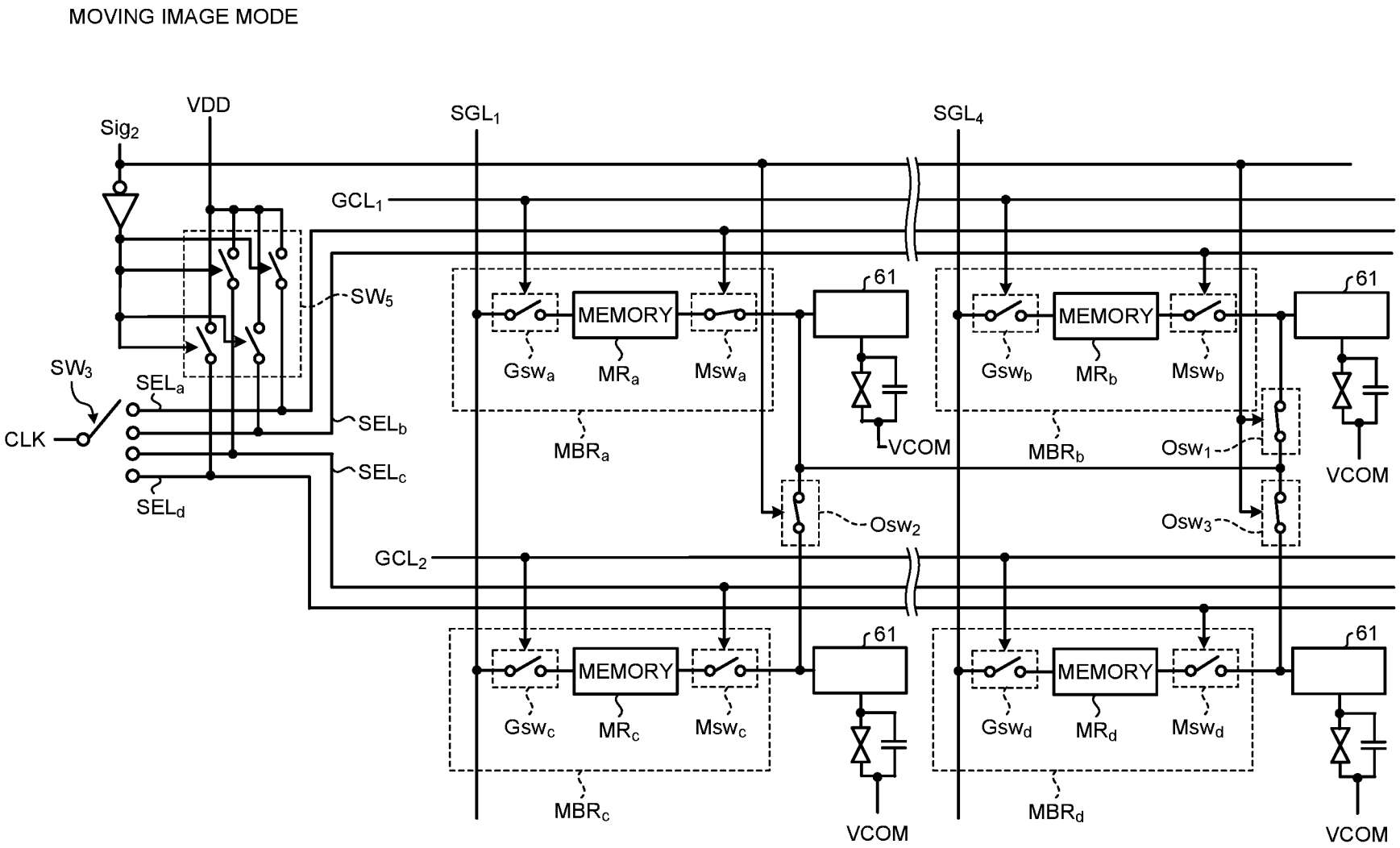
FIG. 9 is a diagram illustrating the circuit configuration of the display device according to the first embodiment.

FIGS. 7, 8, and 9 are diagrams illustrating circuit configurations of the display device 1 according to the first embodiment. FIGS. 7 to 9 illustrates the circuit configuration of the sub-pixels S included in the 2×2 pixels Pix and the memories M included in these sub-pixels S described with reference to FIGS. 3 to 6. In particular, FIGS. 8 and 9 illustrate the circuit configuration of the sub-pixels SR included in the 2×2 pixels Pix and the memories MR included in these sub-pixels SR. The sub-pixel SR includes a memory block MBR, an inversion switch 61, the liquid crystal LQ, a retention capacitor C, and the sub-pixel electrode 15 (refer to FIG. 2). A memory block $MBR_a$ illustrated in FIGS. 7, 8 and 9 is included in the sub-pixel $SR_a$. A memory block $MBR_b$ is included in the sub-pixel $SR_b$. A memory block $MBR_c$ is included in the sub-pixel $SR_c$. A memory block $MBR_d$ is included in the sub-pixel $SR_d$. The memory blocks $MBR_a$, $MBR_b$, $MBR_c$, and $MBR_d$ are each referred to as the memory block MBR when no distinction is made as to which of the sub-pixels $SR_a$, $SR_b$, $SR_c$, or $SR_d$ includes the memory block MBR.

The memory block $MBR_a$ includes a switch $Gsw_a$, the memory $MR_a$, and the switch $Msw_a$. The switch $Gsw_a$ is interposed between a source line $SGL_1$ and the memory $MR_a$, and couples the source line $SGL_1$ to the memory $MR_a$ in response to the gate signal. The sub-pixel data transmitted through the source line $SGL_1$ is stored in the memory $MR_a$, which has been coupled to the source line $SGL_1$ in response to the gate signal.

Gate lines $GCL_1$, $GCL_2$, . . . corresponding to the V rows of the pixels Pix are arranged on the first panel 2. The gate lines $GCL_1$, $GCL_2$, . . . extend along the X-direction in the display area DA (refer to FIG. 1). H×3 source lines $SGL_1$, $SGL_2$, . . . are arranged corresponding to the H×3 columns of the sub-pixel SR on the first panel 2. The source lines $SGL_1$, $SGL_2$, . . . extend along the Y-direction in the display area DA (refer to FIG. 1).

The sub-pixels SR in the same row share the gate line in the same row. For example, the switches $Gsw_a$ and $Gsw_b$ operate in response to the gate signal transmitted through the gate line $GCL_1$. The same description applies to the relation between the switches $Gsw_c$ and $Gsw_d$ and the gate line $GCL_2$. The sub-pixels SR in the same column share the source line in the same column. For example, the switches $Gsw_a$ and $Gsw_c$ are coupled to the source line $SGL_1$. The switches $Gsw_b$ and $Gsw_d$ are coupled to a source line $SGL_4$. The mechanism of operation of each of the switches $Gsw_b$, $Gsw_c$, and $Gsw_d$ is the same that of the switch $Gsw_a$. The source line $SGL_1$ is coupled to components of the sub-pixels $SR_a$ and $SR_c$. The source line $SGL_2$ is coupled to components of the sub-pixels $SG_a$ and $SG_c$. The source line $SGL_3$ is coupled to components of the sub-pixels $SB_a$ and $SB_c$. The source line $SGL_4$ is coupled to components of the sub-pixels $SR_b$ and $SR_d$. A source line $SGL_5$ is coupled to components of the sub-pixels $SG_b$ and $SG_d$. A source line $SGL_6$ is coupled to components of the sub-pixels $SB_b$ and $SB_d$. Although not illustrated, the same description applies to configurations not included in the 2×2 pixels Pix, but included in the other pixels Pix.

The gate line drive circuit 9 includes output terminals corresponding to the V rows of the pixels Pix. The output terminals are coupled to the respective gate lines $GCL_1$, $GCL_2$, . . . . The gate line drive circuit 9 sequentially outputs the gate signal for selecting one of the V rows based on a control signal $Sig_4$ (a scan start signal or a clock pulse signal) supplied from the timing controller 4*b*. The gate signals are transmitted through the gate lines $GCL_1$, $GCL_2$, . . . , and causes the switches $Gsw_a$, $Gsw_b$, $Gsw_c$, $Gsw_d$, . . . to operate.

The source line drive circuit 5 outputs, through the source lines $SGL_1$, $SGL_2$, . . . , the sub-pixel data to the memories provided in the sub-pixels SR selected by the gate signal.

The memory selection circuit 8 includes a switch $SW_2$, a latch 71, and a switch $SW_3$. The switch $SW_2$ is controlled by a control signal $Sig_2$ supplied from the timing controller 4*b*. The timing controller 4*b* switches the control signal $Sig_2$ between high and low levels based on which of a still image or a moving image is displayed. The control signal $Sig_2$ is input to the switch $SW_2$ and the switches included in the switching unit Osw. The control signal $Sig_2$ is inverted and then input to a switch $SW_5$. The switch $SW_5$ opens and closes a path between selection signal lines $SEL_a$, $SEL_b$, $SEL_c$, and $SEL_d$ and a power supply line VDD on a high-potential side.

When a still image is displayed in the first mode, the control signal $Sig_2$ is set to the low level. As a result, as illustrated in FIG. 8, the switches $Osw_1$, $Osw_2$, and $Osw_3$ are supplied with the low-level control signal $Sig_2$ and then opened to be in an uncoupled state. The switch $SW_5$ is supplied with the high-level control signal $Sig_2$, which is obtained by inverting the low-level control signal $Sig_2$, and then closed in response to the high-level signal to couple the selection signal lines $SEL_a$, $SEL_b$, $SEL_c$, and $SEL_d$ to the power supply line VDD on the high-potential side. Examples of the switch operated by the high-level gate signal include an n-channel transistor, but the present disclosure is not limited thereto.

Each of the selection signal lines $SEL_a$, $SEL_b$, $SEL_c$, and $SEL_d$ extends along the X-direction in the display area DA (refer to FIG. 1). The selection signal line $SEL_a$ is coupled to the switch $Msw_a$. Switching between high and low levels of the selection signal line $SEL_a$ opens or closes the switch $Msw_a$. The selection signal line $SEL_b$ is coupled to the switch $Msw_b$. Switching between high and low levels of the selection signal line $SEL_b$ opens or closes the switch $Msw_b$. The selection signal line $SEL_c$ is coupled to the switch $Msw_c$. Switching between high and low levels of the selection signal line $SEL_c$ opens or closes the switch $Msw_c$. The selection signal line $SEL_d$ is coupled to the switch $Msw_d$. Switching between high and low levels of the selection signal line $SEL_d$ opens or closes the switch $Msw_d$.

The selection signal lines $SEL_a$, $SEL_b$, $SEL_c$, and $SEL_d$ coupled to the power supply line VDD on the high-potential side are placed in the same state as that of transmitting the high-level signal. As a result, the switches $Msw_a$, $Msw_b$, $Msw_c$, and $Msw_d$ are closed to be in a coupled state. Accordingly, the first mode is established in which the sub-pixel $SR_a$, the sub-pixel $SR_b$, the sub-pixel $SR_c$, and the sub-pixel $SR_d$ are coupled to the memory $MR_a$, the memory $MR_b$, the memory $MR_c$, and the memory $MR_d$, respectively. In the first mode, the switch $SW_2$ of the memory selection circuit 8 is placed in an uncoupled state because the control signal $Sig_2$ is at the low level.

When a moving image is displayed in the second mode, the control signal $Sig_2$ is set to the high level. As a result, as illustrated in FIG. 9, the switches $Osw_1$, $Osw_2$, and $Osw_3$ are closed to be in a coupled state. In other words, the four sub-pixels SR: the sub-pixel $SR_a$, the sub-pixel $SR_b$, the sub-pixel $SR_c$, and the sub-pixel $SR_d$, are coupled to one another.

The switch $SW_2$ is placed in a coupled state based on the high-level control signal $Sig_2$. As a result, the reference clock signal CLK is supplied to the latch 71. The latch 71 keeps the supplied reference clock signal CLK at a high level for one period of the reference clock signal CLK.

The switch $SW_3$ selects any one of the selection signal lines $SEL_a$, $SEL_b$, $SEL_c$, and $SEL_d$ as a target (coupling target), the coupling target being coupled to an output terminal of the latch 71. The switch $SW_3$ is controlled by a control signal $Sig_3$ supplied from the timing controller 4*b*. The control signal $Sig_3$ is a signal for controlling switching timing of the switch $SW_3$. The switch $SW_3$ sequentially switches the coupling target in response to the control signal $Sig_3$. For example, the switch $SW_3$ switches the coupling target in the order of the selection signal lines $SEL_a$, $SEL_b$, $SEL_c$, and $SEL_d$, and then returns the coupling target to the selection signal line $SEL_a$. The switch $SW_5$ is opened in response to the low-level signal to uncouple the selection signal lines $SEL_a$, $SEL_b$, $SEL_c$, and $SEL_d$ from the power supply line VDD on the high-potential side. Thus, the selection signal lines $SEL_a$, $SEL_b$, $SEL_c$, and $SEL_d$ are set to the high or low level in response to the switching of the switch $SW_3$. The coupling target is set to the high level, and the lines that are not the coupling target are set to the low level.

When any one of the selection signal lines $SEL_a$, $SEL_b$, $SEL_c$, and $SEL_d$ selected as the coupling target of the switch $SW_3$ is set to the high level, a corresponding one of the switches $Msw_a$, $Msw_b$, $Msw_c$, and $Msw_d$ is closed, and the others thereof are opened. Consequently, the four sub-pixels SR (sub-pixels $SR_a$, $SR_b$, $SR_c$, and $SR_d$) coupled to one another, are coupled to any one of the four memories MR (the memory $MR_a$, the memory $MR_b$, the memory $MR_c$, and the memory $MR_d$). When the switch $SW_3$ switches the coupling target in response to the control signal $Sig_3$, the memory MR coupled to the four sub-pixels SR coupled to one another is switched. This operation switches the frame images constituting the moving image.

The common electrode drive circuit 6 inverts the common potential VCOM common to the sub-pixels SR in synchronization with the reference clock signal CLK, and outputs the common potential VCOM inverted in synchronization with the reference clock signal CLK to the common electrode 23 (refer to FIG. 2). The common electrode drive circuit 6 may output, to the common electrode 23, the reference clock signal CLK as it is, as the common potential VCOM. The common electrode drive circuit 6 may output, to the common electrode 23, the reference clock signal CLK as the common potential VCOM through a buffer circuit for amplifying the current driving capacity thereof. The inversion driving of each of the sub-pixels SR is performed by switching the potential thereof relative to the common potential VCOM between high and low levels.

Based on a display signal, the inversion switch 61 supplies the sub-pixel data as it is or in an inverted form to the sub-pixel electrode 15. The liquid crystal LQ is provided between the sub-pixel electrode 15 and the common electrode 23. As illustrated in FIGS. 7 to 9, a configuration can also be employed in which the retention capacitor C is provided by separately providing an electrode opposed to the sub-pixel electrode in the pixel area. Another configuration can also be employed in which no such an electrode is provided and no retention capacitor is included.

The following describes the inversion driving of the sub-pixel S. The inversion switch 61 is interposed between the memory M and the sub-pixel electrode (reflective electrode) 15 (refer to FIG. 2). The inversion switch 61 is supplied with the display signal inverted in synchronization with the reference clock signal CLK from a signal line $FRP_1$.

Figure 10:
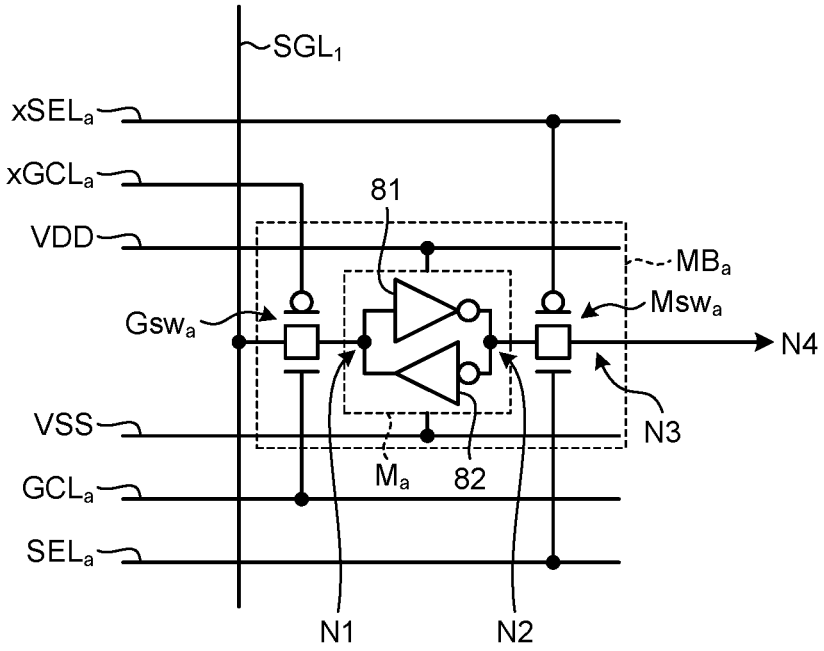
FIG. 10 is a diagram illustrating a circuit configuration of a memory of a sub-pixel of the display device according to the first embodiment.

FIG. 10 is a diagram illustrating a circuit configuration of the memory of the sub-pixel of the display device 1 according to the first embodiment. FIG. 10 is a diagram illustrating the circuit configuration of the memory $M_a$. While FIG. 10 illustrates the memory $M_a$, the memories $M_b$, $M_c$, and $M_d$ can also be illustrated in the same manner (by replacing the subscripts).

The memory $M_a$ has a static random access memory (SRAM) cell structure including an inverter circuit 81 and an inverter circuit 82 that are coupled in parallel in opposite directions.

An input terminal of the inverter circuit 81 and an output terminal of the inverter circuit 82 constitute a node N1, and an output terminal of the inverter circuit 81 and an input terminal of the inverter circuit 82 constitute a node N2. The inverter circuit 81 and the inverter circuit 82 operate using power supplied from the power supply line VDD on the high-potential side and a power supply line VSS on a low-potential side.

The memory block $MB_a$ is coupled to the source line $SGL_1$, a gate line $GCL_a$, the selection signal line $SEL_a$, and the power supply line VDD on the high-potential side, and in addition, to a gate line $xGCL_a$, a selection signal line $xSEL_a$, and the power supply line VSS on the low-potential side.

The node N1 is coupled to an output terminal of the switch $Gsw_a$. FIG. 10 illustrates a transfer gate as an example of the switch $Gsw_a$. One control input terminal of the switch $Gsw_a$ is coupled to the gate line $GCL_a$. The other control input terminal of the switch $Gsw_a$ is coupled to the gate line $xGCL_a$. The gate line $xGCL_a$ is supplied with an inverted gate signal obtained by inverting the gate signal supplied to the gate line $GCL_a$.

An input terminal of the switch $Gsw_a$ is coupled to the source line $SGL_1$. An output terminal of the switch $Gsw_a$ is coupled to the node N1. When the gate signal supplied to the gate line $GCL_a$ is set to a high level and the inverted gate signal supplied to the gate line $xGCL_a$ is set to a low level, the switch $Gsw_a$ is placed in a coupled state to couple the source line $SGL_1$ to the node N1. This operation stores the sub-pixel data supplied to the source line $SGL_1$ into the memory $M_a$.

Figure 11:
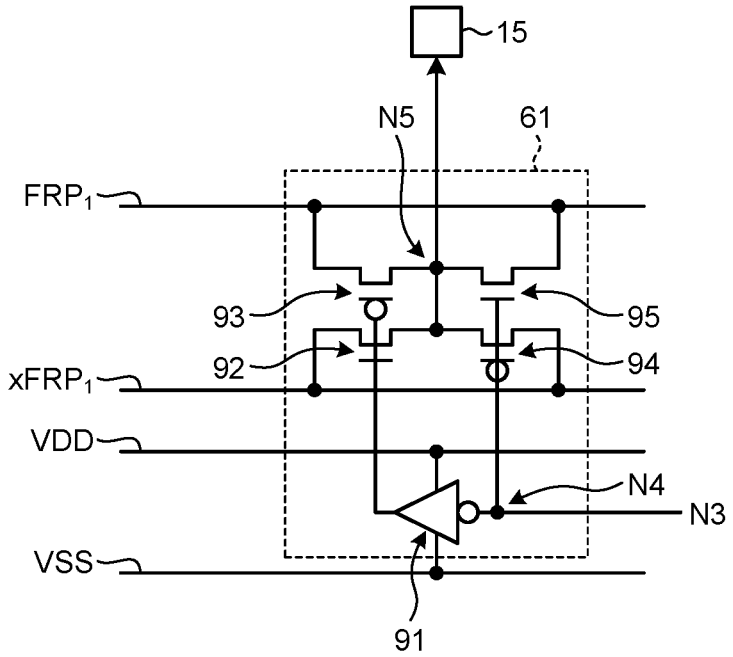
FIG. 11 is a diagram illustrating a circuit configuration of an inversion switch of the sub-pixel of the display device according to the first embodiment.

The node N2 is coupled to an input terminal of the switch $Msw_a$. FIG. 11 illustrates a transfer gate as an example of the switch $Msw_a$. One control input terminal of the switch $Msw_a$ is coupled to the selection signal line $SEL_a$. The other control input terminal of the switch $Msw_a$ is coupled to the selection signal line $xSEL_a$. The selection signal line $xSEL_a$ is supplied with a potential obtained by inverting the potential of the signal supplied to the selection signal line $SEL_a$.

The input terminal of the switch $Msw_a$ is coupled to the node N2. An output terminal of the switch $Msw_a$ is coupled to a node N3. The node N3 is an output node of the memory $M_a$, and is coupled to the inversion switch 61 (refer to FIG. 7). When the potential of the signal supplied to the selection signal line $SEL_a$ is set to a high level and the potential of the signal supplied to the selection signal line $xSEL_a$ is set to a low level, the switch $Msw_a$ is placed in a coupled state. This operation couples the node N2 to an input terminal of the inversion switch 61 through the switch $Msw_a$ and the node N3. This operation, in turn, supplies the sub-pixel data being stored in the memory $M_a$ to the inversion switch 61. When both the switch $Gsw_a$ and the switch $Msw_a$ are in an uncoupled state, the sub-pixel data circulates in a loop formed by the inverter circuits 81 and 82. Thus, the memory $M_a$ continues to retain the sub-pixel data.

In the first embodiment, the exemplary case has been described where the memory M is an SRAM. However, the present disclosure is not limited thereto. The memory M may be a dynamic random access memory (DRAM), for example.

FIG. 11 is a diagram illustrating a circuit configuration of the inversion switch of the sub-pixel of the display device 1 according to the first embodiment. Based on the display signal, the inversion switch 61 inverts the sub-pixel data and then supplies the sub-pixel data to the sub-pixel electrode 15 at intervals of a constant period. In the first embodiment, the period of the inversion of the display signal is the same as the period of the inversion of the potential (common potential VCOM) of the common electrode 23. The inversion switch 61 includes an inverter circuit 91, n-channel transistors 92 and 95, and p-channel transistors 93 and 94.

An input terminal of the inverter circuit 91, a gate terminal of the p-channel transistor 94, and a gate terminal of the n-channel transistor 95 are coupled to a node N4. The node N4 is an input node of the inversion switch 61, and is coupled to the nodes N3 of the memory $M_a$. The node N4 is supplied with the sub-pixel data from the memory $M_a$. The inverter circuit 91 operates using power supplied from the power supply line VDD on the high-potential side and the power supply line VSS on the low-potential side.

One of the source and the drain of the n-channel transistor 92 is coupled to a signal line $xFRP_1$. One of the source and the drain of the p-channel transistor 93 is coupled to the signal line $FRP_1$. One of the source and the drain of the p-channel transistor 94 is coupled to the signal line $xFRP_1$. One of the source and the drain of the n-channel transistor 95 is coupled to the signal line $FRP_1$. The other of the source and the drain of each of the n-channel transistor 92, the p-channel transistor 93, the p-channel transistor 94, and the n-channel transistor 95 is coupled to a node N5.

The node N5 is an output node of the inversion switch 61, and is coupled to the reflective electrode (sub-pixel electrode) 15. If the sub-pixel data supplied from the memory $M_a$ is at a high level, the output signal of the inverter circuit 91 is at a low level. If the output signal of the inverter circuit 91 is at the low level, the n-channel transistor 92 is placed in an uncoupled state, and the p-channel transistor 93 is placed in a coupled state.

If the sub-pixel data supplied from the memory $M_a$ is at the high level, the p-channel transistor 94 is placed in an uncoupled state, and the n-channel transistor 95 is placed in a coupled state. Thus, if the sub-pixel data supplied from the memory $M_a$ is at the high level, the display signal supplied to the signal line $FRP_1$ is supplied to the sub-pixel electrode 15 through the p-channel transistor 93 and the n-channel transistor 95.

The display signal supplied to the signal line $FRP_1$ and the common potential VCOM supplied to the common electrode 23 are inverted in synchronization with, for example, the reference clock signal CLK. When the display signal is in phase with the common potential VCOM, that is, for example, when these signals always keep the same potential as each other, no voltage is applied to the liquid crystal LQ, so that the orientation of the molecules does not change. As a result, the sub-pixel is placed in a black display state (a state of not transmitting the reflected light, that is, a state in which the reflected light does not pass through the color filter, and no color is displayed).

If the sub-pixel data supplied from the memory $M_a$ is at a low level, the output signal of the inverter circuit 91 is at a high level. If the output signal of the inverter circuit 91 is at the high level, the n-channel transistor 92 is placed in a coupled state, and the p-channel transistor 93 is placed in a uncoupled state.

If the sub-pixel data supplied from the memory $M_a$ is at the low level, the p-channel transistor 94 is placed in a coupled state, and the n-channel transistor 95 is placed in an uncoupled state. Thus, if the sub-pixel data supplied from the memory $M_a$ is at the low level, the inverted display signal supplied to the signal line $xFRP_1$ is supplied to the sub-pixel electrode 15 through the n-channel transistor 92 and the p-channel transistor 94.

The inverted display signal supplied to the signal line $xFRP_1$ is inverted in synchronization with the reference clock signal CLK. When the inverted display signal is out of phase with the common potential VCOM, a voltage is applied to the liquid crystal LQ, so that the orientation of the molecules changes. As a result, the sub-pixel is placed in a white display state (a state of transmitting the reflected light, that is, a state in which the reflected light passes through the color filter, and colors are displayed).

The reference clock signal CLK is supplied from the inversion drive circuit 7. As illustrated in FIG. 7, the inversion drive circuit 7 includes a switch $SW_1$. The switch $SW_1$ is controlled by a control signal $Sig_1$ supplied from the timing controller 4*b*. If the control signal $Sig_1$ is a first value (at, for example, a low level), the switch $SW_1$ supplies the reference clock signal CLK to signal lines $FRP_1$, $FRP_2$, . . . . If the control signal $Sig_1$ is a second value (at, for example, a high level), the switch $SW_1$ supplies a reference potential (ground potential) GND to the signal lines $FRP_1$, $FRP_2$, . . . .

In the present embodiment, the common potential supplied to the common electrode is an alternating current (AC) signal. The signal line FRP is supplied with an AC signal having the same phase as the common potential, and the signal line xFRP is supplied with an AC signal in the opposite phase to the common potential. However, another configuration can also be employed in which the common potential supplied to the common electrode is a direct current (DC) having a predetermined fixed potential, and the signal line FRP is supplied with a direct current having the predetermined fixed potential whereas the signal line xFRP is supplied with an AC signal inverted in polarity with respect to the fixed potential.

Figure 12:
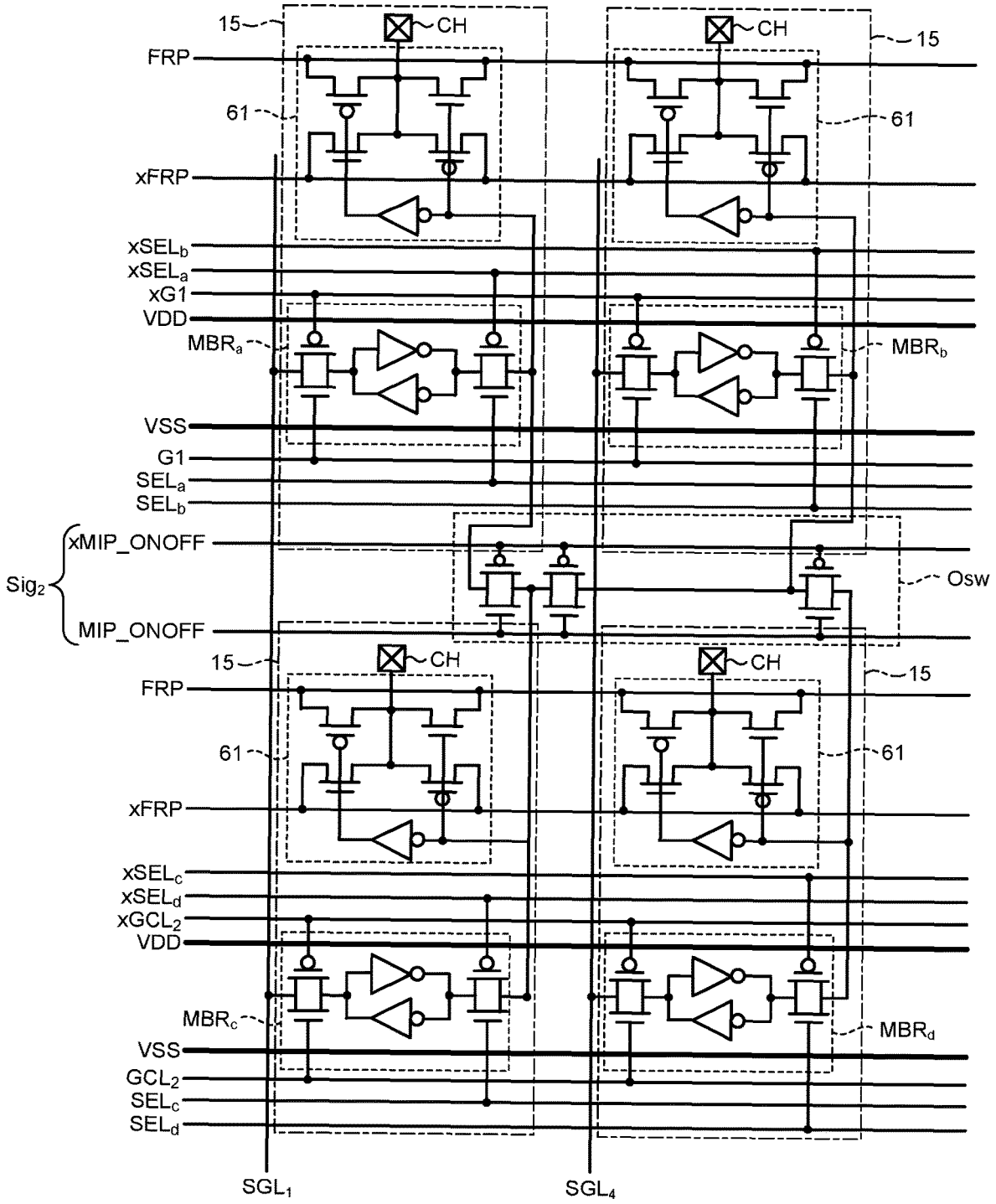
FIG. 12 is a diagram illustrating a circuit configuration example including memory blocks, inversion switches, a switching unit, and wiring that transmits various signals for controlling these components.

FIG. 12 is a diagram illustrating a circuit configuration example including the memory blocks MBR, the inversion switches 61, the switching unit Osw, and wiring that transmits various signals for controlling these components. The inversion switch 61 and the memory block MBR on the first panel 2 are arranged in the Y-direction. On the first panel 2, the V signal lines $FRP_1$, $FRP_2$, . . . and V signal lines $xFRP_1$, $xFRP_2$, . . . are arranged corresponding to the V rows of the pixels Pix. Each of the V signal lines $FRP_1$, $FRP_2$, . . . and the V signal lines $xFRP_1$, $xFRP_2$, . . . extends in the X-direction in the display area DA (refer to FIG. 1). The sub-pixel electrode 15 of each of the sub-pixels S is stacked in an area provided with the memory block MBR and the inversion switch 61 of the sub-pixel S. When viewed from the display surface 1*a* side, the memory block MBR and the inversion switch 61 of each of the sub-pixels S are located on the back side of the sub-pixel electrode 15. The sub-pixel electrode 15 is coupled to the inversion switch 61 through a contact hole CH.

The switching unit Osw is provided between rows of the sub-pixels S. Although the switching unit Osw illustrated in FIG. 12 has a different configuration from the configuration including the switches $Osw_1$, $Osw_2$, and $Osw_3$ described with reference to FIG. 4 and other figures, the switching unit Osw is capable of switching between whether the sub-pixels (for example, the four sub-pixels $S_a$, $S_b$, $S_c$, and $S_d$) are coupled to one of the memories M and whether the respective sub-pixels are coupled to the different memories M. The switching unit Osw illustrated in FIG. 12 includes a switch that opens and closes wiring between the sub-pixel $S_a$ and the sub-pixel $S_c$, a switch that opens and closes wiring between the sub-pixel $S_b$ and the sub-pixel $S_c$, and a switch that opens and closes wiring between the sub-pixel $S_b$ and the sub-pixel $S_d$. First wiring MIP_ONOFF and second wiring xMIP_ONOFF are provided for supplying the control signal $Sig_2$ to the switching unit Osw. FIG. 12 illustrates an example in which transfer gates are used as the switches (for example, the switches $Osw_1$, $Osw_2$, and $Osw_3$) included in the switching unit Osw. The first wiring MIP_ONOFF transmits the control signal $Sig_2$. The second wiring xMIP_ONOFF transmits an inverted signal of the control signal $Sig_2$. The sub-pixel electrodes 15 extend on the display surface 1*a* sides of the first wiring MIP_ONOFF and the second wiring xMIP_ONOFF. Specifically, the sub-pixel electrode 15 of each of the sub-pixels $S_a$ and $S_b$ is stacked on the display surface 1*a* side of the second wiring xMIP_ONOFF, and the sub-pixel electrode 15 of each of the sub-pixels $S_c$ and $S_a$ is stacked on the display surface 1*a* side of the first wiring MIP_ONOFF. The sub-pixel electrode 15 extends on the display surface 1*a* side of wiring for coupling the switching unit Osw to the memory block MBR of each of the sub-pixels S. In other words, when viewed from the display surface 1*a* side, the sub-pixel electrode 15 covers most part of the first wiring MIP_ONOFF, the second wiring xMIP_ONOFF, and the wiring for coupling the switching unit Osw to the memory block MBR of each of the sub-pixels S.

Figure 13:
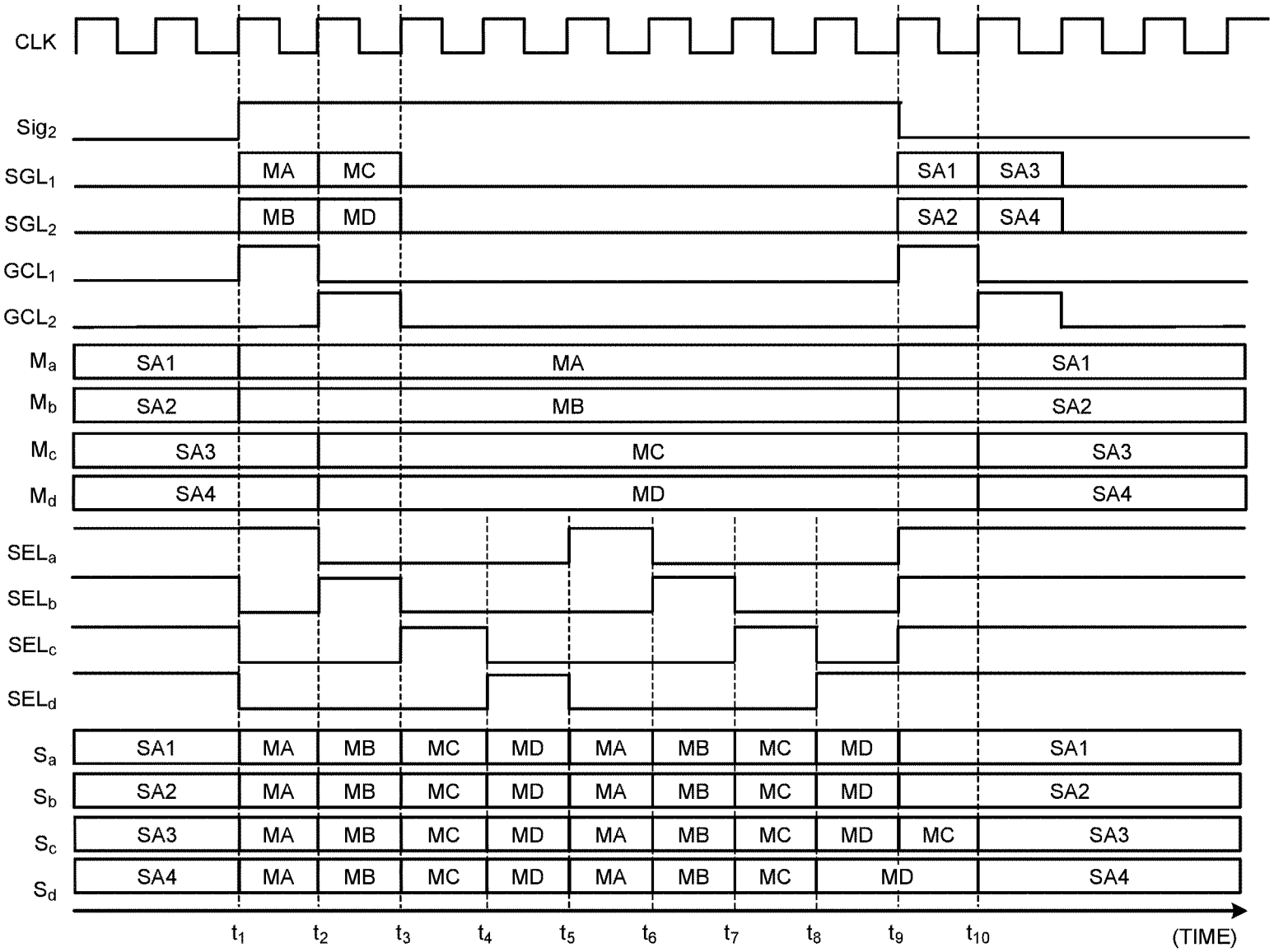
FIG. 13 is a timing diagram illustrating operation timing of the display device according to the first embodiment.

FIG. 13 is a timing diagram illustrating operation timing of the display device 1 according to the first embodiment. Over the entire period of time illustrated in FIG. 13, the common electrode drive circuit 6 supplies, to the common electrode 23, the common potential VCOM inverted in synchronization with the reference clock signal CLK. Although FIG. 13 is the timing diagram for the display device that performs the display of the 2×2 pixels (=2×2×3=12 sub-pixels), the present embodiment is naturally applicable not only to this display device, but also to the display device having the V×H pixels based on the timing diagram. Hereinafter, when the colors of the pixels need not be distinguished from one another, the following representative symbols, for example, are used: $S_a$ for the sub-pixels of the pixel $Pix_a$, $M_a$ for the memories thereof, SA1 to SA4 for sub-pixel data for a still image (still image sub-pixel data), and MA to MD for sub-pixel data for a moving image (moving image sub-pixel data). Although not illustrated, of the still image sub-pixel data SA1 to SA4, the sub-pixel data written to the memory MR is denoted by SAR1 to SAR4, the sub-pixel data written to the memory MG is denoted by SAG1 to SAG4, and the sub-pixel data written to the memory MB is denoted by SAB1 to SAB4. In the same manner, of the moving image sub-pixel data MA to MD, the sub-pixel data written to the memory MR is denoted by MAR to MDR, the sub-pixel data written to the memory MG is denoted by MAG to MDG, and the sub-pixel data written to the memory MB is denoted by MAB to MDB.

Before time $t_1$, the display device 1 operates in the first mode. The memories $M_a$ ($MR_a$, $MG_a$, and $MB_a$; the same applies hereinafter), $M_b$ ($MR_b$, $MG_b$, and $MB_b$; the same applies hereinafter), $M_c$ ($MR_c$, $MG_c$, and $MB_c$; the same applies hereinafter), and $M_d$ ($MR_d$, $MR_d$, and $MB_d$; the same applies hereinafter) respectively store therein the still image sub-pixel data SA1 (SAR1, SAG1, and SAB1; the same applies hereinafter), SA2 (SAR2, SAG2, and SAB2; the same applies hereinafter), SA3 (SAR3, SAG3, and SAB3; the same applies hereinafter), and SA4 (SAR4, SAG4, and SAB4; the same applies hereinafter). Since the control signal $Sig_2$ is at the low level, the coupling of the sub-pixels S is not established by the switching unit Osw. Since the selection signal lines $SEL_a$, $SEL_b$, $SEL_c$, and $SEL_d$ are coupled to the power supply line VDD on the high-potential side, all the selection signal lines $SEL_a$, $SEL_b$, $SEL_c$, and $SEL_d$ are at the high level. Thus, for example, the sub-pixel $SR_a$, the sub-pixel $SR_b$, the sub-pixel $SR_c$, and the sub-pixel $SR_d$ are coupled to the memory $MR_a$, the memory $MR_b$, the memory $MR_c$, and the memory $MR_d$, respectively. The same description applies to the other sub-pixels (sub-pixels SG and SB). Thus, the gradations of the sub-pixels $S_a$, $S_b$, $S_c$, and $S_d$ are maintained in states controlled according to the still image sub-pixel data SA1, SA2, SA3, and SA4.

In the example illustrated in FIG. 13, the mode changes from the first mode to the second mode at time $t_1$. At time $t_1$, the gate signal is transmitted through the gate line $GCL_1$ (or a gate line $xGCL_1$). The moving image sub-pixel data MA (MRA, MGA, and MBA) and moving image sub-pixel data MB (MRB, MGB, and MBB) are transmitted through the source lines $SGL_1$ to $SGL_3$ and $SGL_4$ to $SGL_6$. This operation changes the pieces of data being stored in the memories $M_a$ and $M_b$ from the still image sub-pixel data SA1 and SA2 to the moving image sub-pixel data MA and MB. For example, the pieces of data being stored in the memories $MR_a$ and $MR_b$ are changed from the still image sub-pixel data SAR1 and SAR2 to the moving image sub-pixel data MAR and MBR. The same description applies to the other sub-pixels (sub-pixels SG and SB).

At time $t_1$, the control signal $Sig_2$ is changed from the state corresponding to the first mode (for example, the low level) to the state corresponding to the second mode (for example, the high level). Since the control signal $Sig_2$ is at the high level, the coupling of the sub-pixels S is established by the switching unit Osw. The selection signal lines $SEL_a$, $SEL_b$, $SEL_c$, and $SEL_d$ are not coupled to the power supply line VDD on the high-potential side. As a result, from time $t_1$ onward, any one of the selection signal lines $SEL_a$, $SEL_b$, $SEL_c$, and $SEL_d$ is selected by the latch 71, and the selected one is set to the high level, while the others being set to the low level. Thus, the four sub-pixels S: the sub-pixel $S_a$, the sub-pixel $S_b$, the sub-pixel $S_c$, and the sub-pixel $S_d$, are coupled to any one of the four memories M of the memory $M_a$, the memory $M_b$, the memory $M_c$, and the memory $M_d$. More specifically, the sub-pixels $SR_a$, $SR_b$, SRS, and $SR_d$ are coupled to any one of the four memories MR: the memory $MR_a$, the memory $MR_b$, the memory $MR_c$, and the memory $MR_d$. The same description applies to the other sub-pixels (sub-pixels SG and SB). The four sub-pixels S are controlled in gradation according to the sub-pixel data being stored in one of the memories M that is coupled thereto. For example, the selection signal line $SEL_a$ is set to the high level at times $t_1$ and $t_5$. Accordingly, the four sub-pixels S are controlled in gradation according to the moving image sub-pixel data MA being stored in the memory $M_a$. More specifically, the four sub-pixels: the sub-pixels $SR_a$, the sub-pixels $SR_b$, the sub-pixels $SR_c$, and the sub-pixels $SR_d$, are controlled in gradation according to the moving image sub-pixel data MRA being stored in the memory $MR_a$. The same description applies to the other sub-pixels (sub-pixels SG and SB).

At time $t_2$, the gate signals are transmitted through the gate lines $GCL_1$ and $GCL_2$ (or gate lines $xGCL_1$ and $xGCL_2$). Moving image sub-pixel data MC and moving image sub-pixel data MD are transmitted through the source lines $SGL_1$ to $SGL_3$ and $SGL_4$ to $SGL_6$. This operation changes the data being stored in the memories $M_c$ and $M_d$ from the still image sub-pixel data SA3 and SA4 to the moving image sub-pixel data MC and MD. For example, the pieces of data being stored in the memories $MR_c$ and $MR_d$ are changed from the still image sub-pixel data SAR3 and SAR4 to moving image sub-pixel data MCR and MDR. The same description applies to the other sub-pixels (sub-pixels SG and SB). The sub-pixel data MA, the sub-pixel data MB, the sub-pixel data MC, and the sub-pixel data MD are pieces of moving image sub-pixel data corresponding to different one-frame images. In other words, in the case of the second mode, the four memories: the memory $M_a$, the memory $M_b$, the memory $M_c$, and the memory $M_d$, retain data corresponding to a predetermined number of the frame images constituting the moving image.

As described above, in the second mode, the four sub-pixels S are controlled in gradation according to the sub-pixel data of the memory M corresponding to one of the selection signal lines $SEL_a$, $SEL_b$, $SEL_c$, and $SEL_d$ set to a high level. At times $t_2$ and $t_6$, the selection signal line $SEL_b$ is set to the high level. Accordingly, the four sub-pixels S are controlled in gradation according to the moving image sub-pixel data MA being stored in the memory $M_b$. For example, the four sub-pixels: the sub-pixels $SR_a$, the sub-pixels $SR_b$, the sub-pixels $SR_c$, and the sub-pixels $SR_d$, are controlled in gradation according to the sub-pixel data MRB for the moving data being stored in the memory $MR_b$. At times $t_3$ and $t_7$, the selection signal line $SEL_c$ is set to the high level, and the four sub-pixels S are controlled in gradation according to the sub-pixel data MA for the moving data being stored in the memory $M_c$. For example, the four sub-pixels: the sub-pixels $SR_a$, the sub-pixels $SR_b$, the sub-pixels $SR_c$, and the sub-pixels $SR_d$, are controlled in gradation according to the sub-pixel data MRC for the moving data being stored in the memory $MR_c$. At times $t_4$ and $t_8$, the selection signal line $SEL_d$ is set to the high level, and the four sub-pixels S are controlled in gradation according to the sub-pixel data MA for the moving data being stored in the memory $M_d$. For example, the four sub-pixels: the sub-pixels $SR_a$, the sub-pixels $SR_b$, the sub-pixels $SR_c$, and the sub-pixels $SR_d$, are controlled in gradation according to the sub-pixel data MRD for the moving data being stored in the memory $MR_d$. While the gradation control performed during a time period from time $t_2$ to time $t_4$ and a time period from time $t_6$ to time $t_8$ has been described above by exemplifying the sub-pixels SR, the same description applies to the other sub-pixels (sub-pixels SG and SB).

In the example illustrated in FIG. 13, the mode changes from the second mode to the first mode at time $t_9$. At time $t_9$, the gate signals are transmitted through the gate lines $GCL_1$ and $GCL_2$ (or the gate lines $xGCL_1$ and $xGCL_2$). The still image sub-pixel data SA1 and still image sub-pixel data SA2 are transmitted through the source lines $SGL_1$ to $SGL_3$ and $SGL_4$ to $SGL_6$. This operation changes the data being stored in the memories $M_a$ and $M_b$ from the moving image sub-pixel data MA and MB to the still image sub-pixel data SA1 and SA2. For example, the pieces of data being stored in the memories $MR_a$ and $MR_b$ are changed from the moving image sub-pixel data MAR and MBR to the still image sub-pixel data SAR1 and SAR2. The same description applies to the other sub-pixels (sub-pixels SG and SB).

At time $t_9$, the control signal $Sig_2$ is changed from the state corresponding to the second mode (for example, the high level) to the state corresponding to the first mode (for example, the low level). As a result, the coupling of the sub-pixels S established by the switching unit Osw and the coupling between the selection signal lines $SEL_a$, $SEL_b$, $SEL_c$, and $SEL_d$ and the power supply line VDD on the high-potential side become the same state as those before time $t_1$. After time $t_9$, the gradations of the sub-pixels $S_a$ and $S_b$ are maintained in the states controlled according to the still image sub-pixel data SA1 and SA2.

At time $t_{10}$, the gate signals are transmitted through the gate lines $GCL_1$ and $GCL_2$ (or the gate lines $xGCL_1$ and $xGCL_2$). The still image sub-pixel data SA3 and still image sub-pixel data SA4 are transmitted through the source lines $SGL_1$ and $SGL_4$. This operation changes the data being stored in the memories $M_c$ and $M_d$ from the moving image sub-pixel data MC and MD to the still image sub-pixel data SA3 and SA4. For example, the pieces of data being stored in the memories $MR_c$ and $MR_d$ are changed from the moving image sub-pixel data MCR and MDR to the still image sub-pixel data SAR3 and SAR4. The same description applies to the other sub-pixels (sub-pixels SG and SB). After time $t_{10}$, the gradations of the sub-pixels $S_c$ and $S_d$ are maintained in the states controlled according to the still image sub-pixel data SA3 and SA4.

According to the first embodiment described above, the display device 1 is capable of selecting either the first mode for displaying a still image or the second mode for displaying a moving image. The first mode is a mode in which each of the sub-pixels S is coupled to the memory M provided in the sub-pixel S. The second mode is a mode including the time periods in each of which some of the sub-pixels S are coupled to the memory provided in another of the sub-pixels S. In other words, each of the sub-pixels S is capable of being coupled to a memory provided in another of the sub-pixels S. As a result, the display device 1 can display a moving image without providing, in each of the sub-pixels S, memories the number of which corresponds to the number of frames of the moving image. Accordingly, the display device 1 can display a moving image having frames the number of which exceeds the number of memories provided in each of the pixels Pix and a still image having a higher definition than that of the moving image.

The second mode can be a mode in which a predetermined number of the sub-pixels S are coupled to one of the memories M provided in the predetermined number of the sub-pixels S, and the memory being coupled to the predetermined number of the sub-pixels S is changed at predetermined intervals of time. The predetermined number is two or greater. When the display device 1 operates in the second mode, the predetermined number of the memories M provided in the predetermined number of the sub-pixels S can store therein the pieces of data corresponding to the predetermined number of the frame images constituting a moving image. As a result, the display device 1 can display the moving image including the predetermined number of the frame images without providing, in each of the sub-pixels S, memories the number of which corresponds to the number of frames of the moving image. When the predetermined number of the sub-pixels S are the sub-pixels S having the same color included in the predetermined number of the pixels Pix, the sub-pixel data corresponding to the sub-pixels S having the same color can more easily be shared.

Second Embodiment

The following describes a display device according to a second embodiment. In the description of the second embodiment, the same items as those in the first embodiment are denoted by the same reference numerals, and will not be described in some cases.

Figure 14:
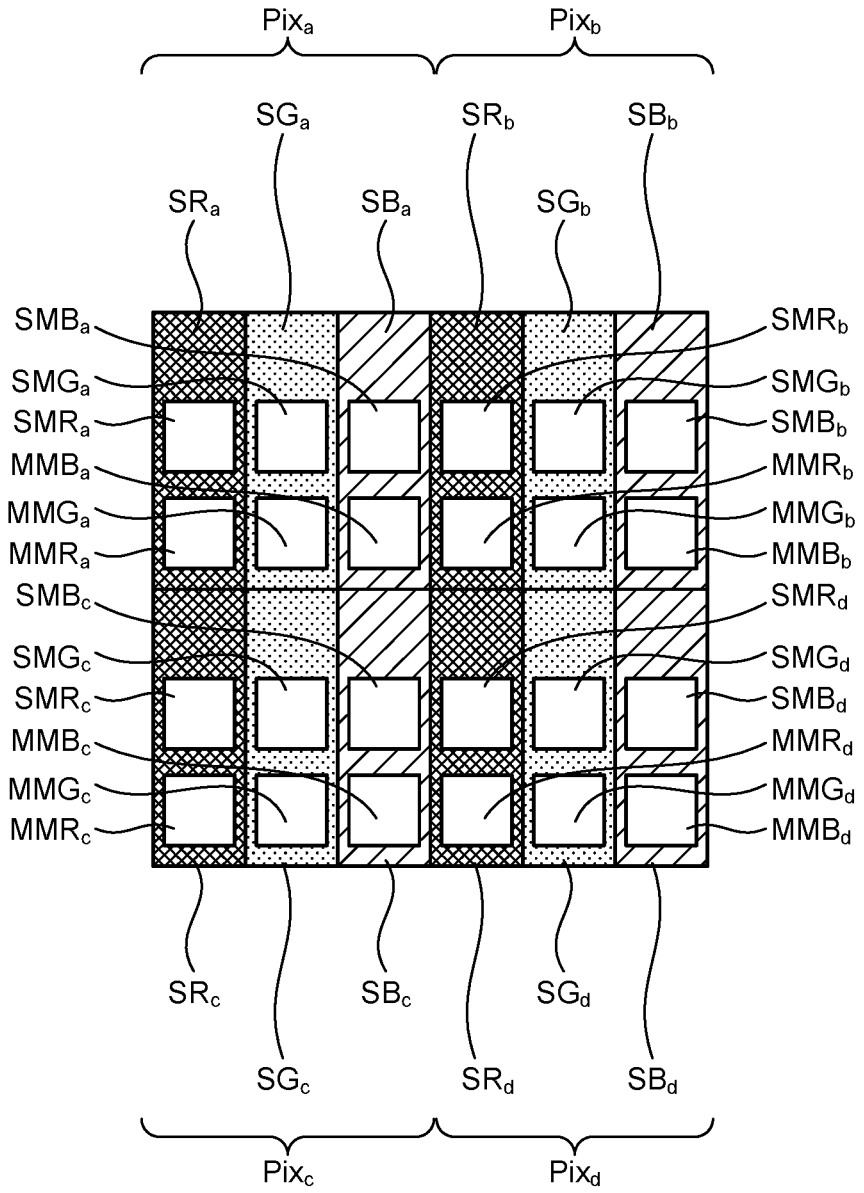
FIG. 14 is a schematic diagram illustrating an example of the sub-pixels included in the 2×2 pixels and the memories included in these sub-pixels in a second embodiment.

FIG. 14 is a schematic diagram illustrating an example of the sub-pixels S included in the 2×2 pixels Pix and the memories M included in these sub-pixels S in the second embodiment. As illustrated, for example, in FIG. 14, two memories are disposed in each of the sub-pixels S in the second embodiment. For example, the red (R) sub-pixel $SR_a$ includes a memory $SMR_a$ and a memory $MMR_a$; the green (G) sub-pixel $SG_a$ includes a memory $SMG_a$ and a memory $MMG_a$; and the blue (B) sub-pixel $SB_a$ includes a memory $SMB_a$ and a memory $MMB_a$. Each of the memories $SMR_a$, $SMG_a$, and $SMB_a$ is the memory M for a still image (still image memory M). Each of the memories $MMR_a$, $MMG_a$, and $MMB_a$ is the memory M for a moving image (moving image memory M). While the configuration described herein is a configuration included in the sub-pixel $S_a$ of the second embodiment, the same configuration applies to the sub-pixels $S_b$, $S_c$, and $S_d$ of the second embodiment (by replacing the subscripts). Each of the memories $SMR_a$, $SMG_a$, and $SMB_a$ is referred to as a memory $SM_a$ when particularly not distinguished from one another. Each of the memories $MMR_a$, $MMG_a$, and $MMB_a$ is referred to as a memory $MM_a$ when particularly not distinguished from one another.

Figure 15:
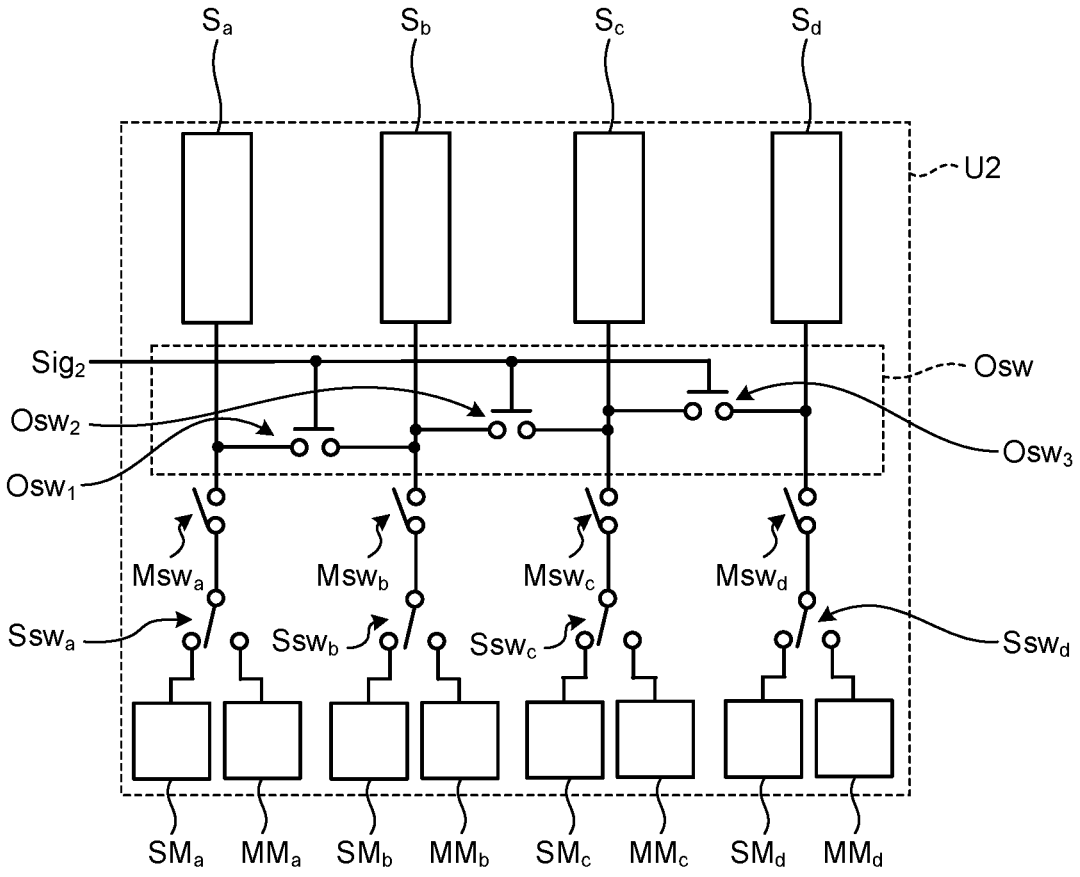
FIG. 15 is a schematic diagram of a circuit including the four sub-pixels and the four memories in the second embodiment.

FIG. 15 is a schematic diagram of a circuit U2 including the four sub-pixels S and the eight memories M in the second embodiment. In the description of the circuit U2 with reference to FIGS. 15 and 16, only differences from the circuit U1 described with reference to FIG. 4 will be described. The circuit U2 includes a switch $Ssw_a$, a switch $Ssw_b$, a switch $Ssw_c$, and a switch $Ssw_d$, in addition to the configuration of the circuit U1. The memory $M_a$ in the circuit U1 is replaced with the two memories $SM_a$ and $MM_a$ in the circuit U2. In the same manner, the memory $M_b$, the memory $M_c$, and the memory $M_d$ are replaced with the memories $SM_b$ and $MM_b$, the memories $SM_c$ and $MM_c$, and the memories $SM_d$ and $MM_d$.

The switch $Ssw_a$ selects either the memory $SM_a$ or memory $MM_a$ as the memory M that is coupled to the switch $Msw_a$. The switch $Ssw_a$ is disposed between the sub-pixel $S_a$ and the memory $M_a$. The same description applies to the switches $SSW_b$, $Ssw_c$, and $Ssw_d$ (by replacing the subscripts).

Figure 16:
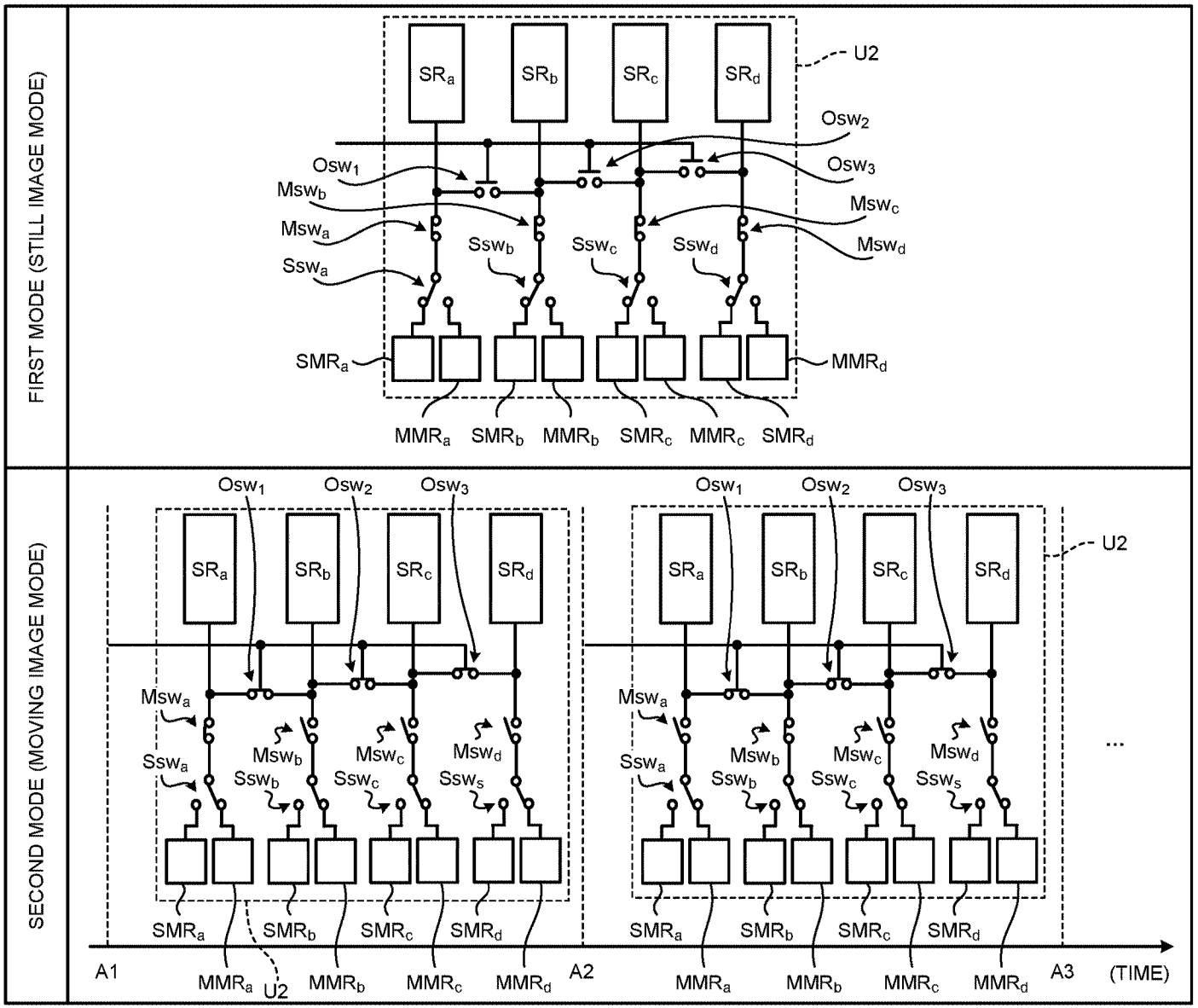
FIG. 16 is a schematic diagram illustrating exemplary coupling configurations in the circuit that differ between the first mode and the second mode in the second embodiment.

FIG. 16 is a schematic diagram illustrating exemplary coupling configurations in the circuit U2 that differ between the first mode and the second mode in the second embodiment. In the description with reference to FIG. 16 to FIG. 18

(to be discussed later), the sub-pixel SR (sub-pixel $SR_a$, $SR_b$, $SR_c$, or $SR_d$) is replaceable with the sub-pixel SG or the sub-pixel SB. The memory SMR (memory $SMR_a$, $SMR_b$, $SMR_c$, or $SMR_d$) is replaceable with that of the same configuration corresponding to the color of the sub-pixel (memory $SMG_a$, $SMG_b$, $SMG_c$ or $SMG_d$ or memory $SMB_a$, $SMB_b$, $SMB_c$ or $SMB_d$). The memory MMR (memory $MMR_a$, $MMR_b$, $MMR_c$ or $MMR_a$) is replaceable with that of the same configuration corresponding to the color of the sub-pixel (memory $MMG_a$, $MMG_b$, $MMG_c$ or $MMG_a$ or memory $MMB_a$, $MMB_b$, $MMB_c$ or $MMB_d$). The replacement changes the description to that of the sub-pixel SG or the sub-pixel SB. In the first mode, the switch $Ssw_a$ couples the switch $Msw_a$ to the memory $SMR_a$. The same description applies to the switches $Ssw_b$, $Ssw_c$, and $Ssw_d$ (by replacing the subscripts). As a result, the sub-pixel $SR_a$, the sub-pixel $SR_b$, the sub-pixel $SR_c$, and the sub-pixel $SR_d$ are coupled to the memory $SMR_a$, the memory $SMR_b$, the memory $SMR_c$, and the memory $SMR_d$, respectively.

In the second mode, the switch $Ssw_a$ couples the switch $Msw_a$ to the memory $MMR_a$. The same description applies to the switches $Ssw_b$, $Ssw_c$, and $Ssw_d$ (by replacing the subscripts). As a result, the four sub-pixels SR: the sub-pixel $SR_a$, the sub-pixel $SR_b$, the sub-pixel $SR_c$, and the sub-pixel $SR_d$, are coupled to any one of the four memories M: the memory $MMR_a$, the memory $MMR_b$, the memory $MMR_c$, and the memory $MMR_d$.

Figure 17:
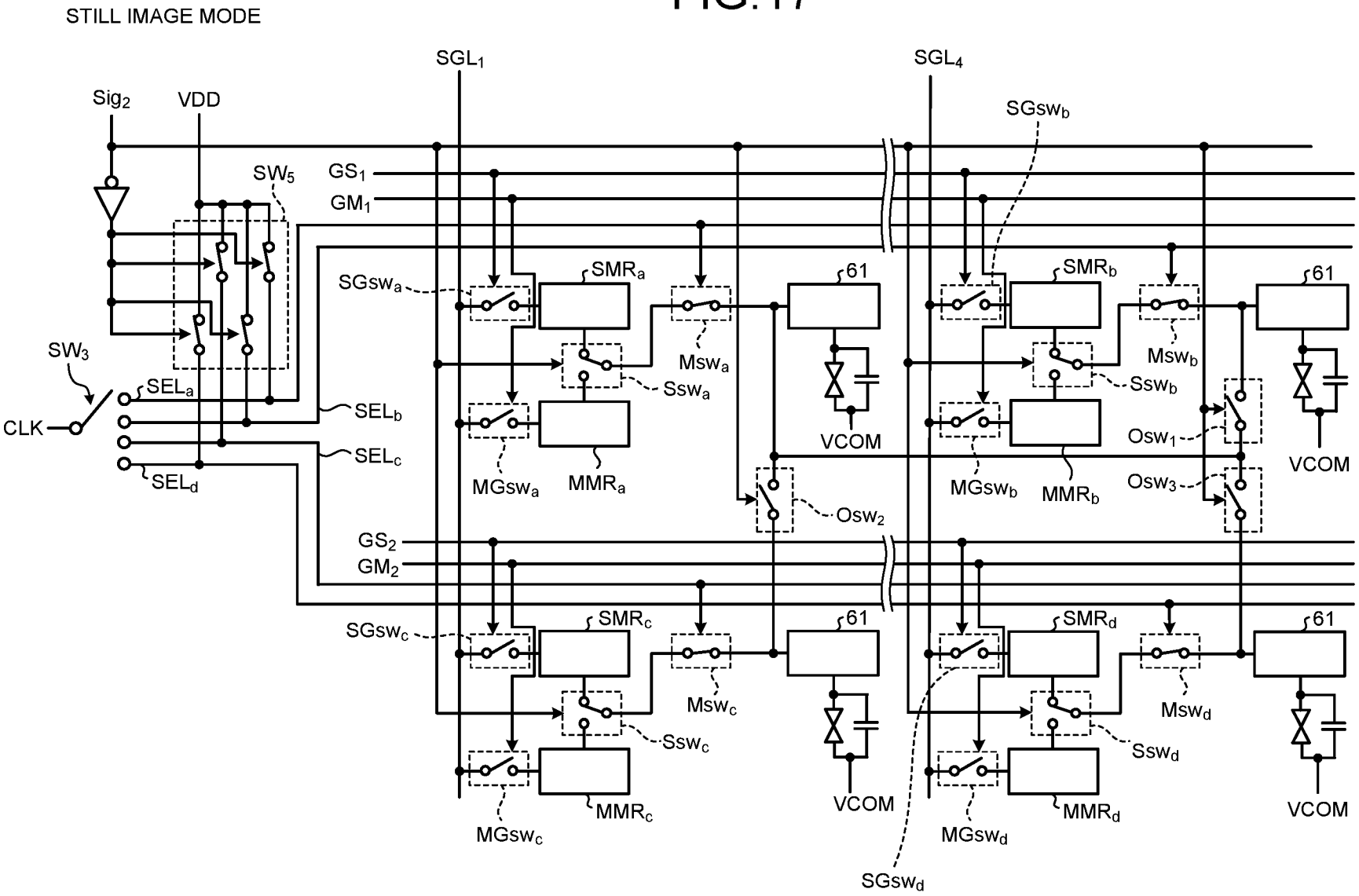
FIG. 17 is a diagram illustrating a circuit configuration of a display device according to the second embodiment.
Figure 18:
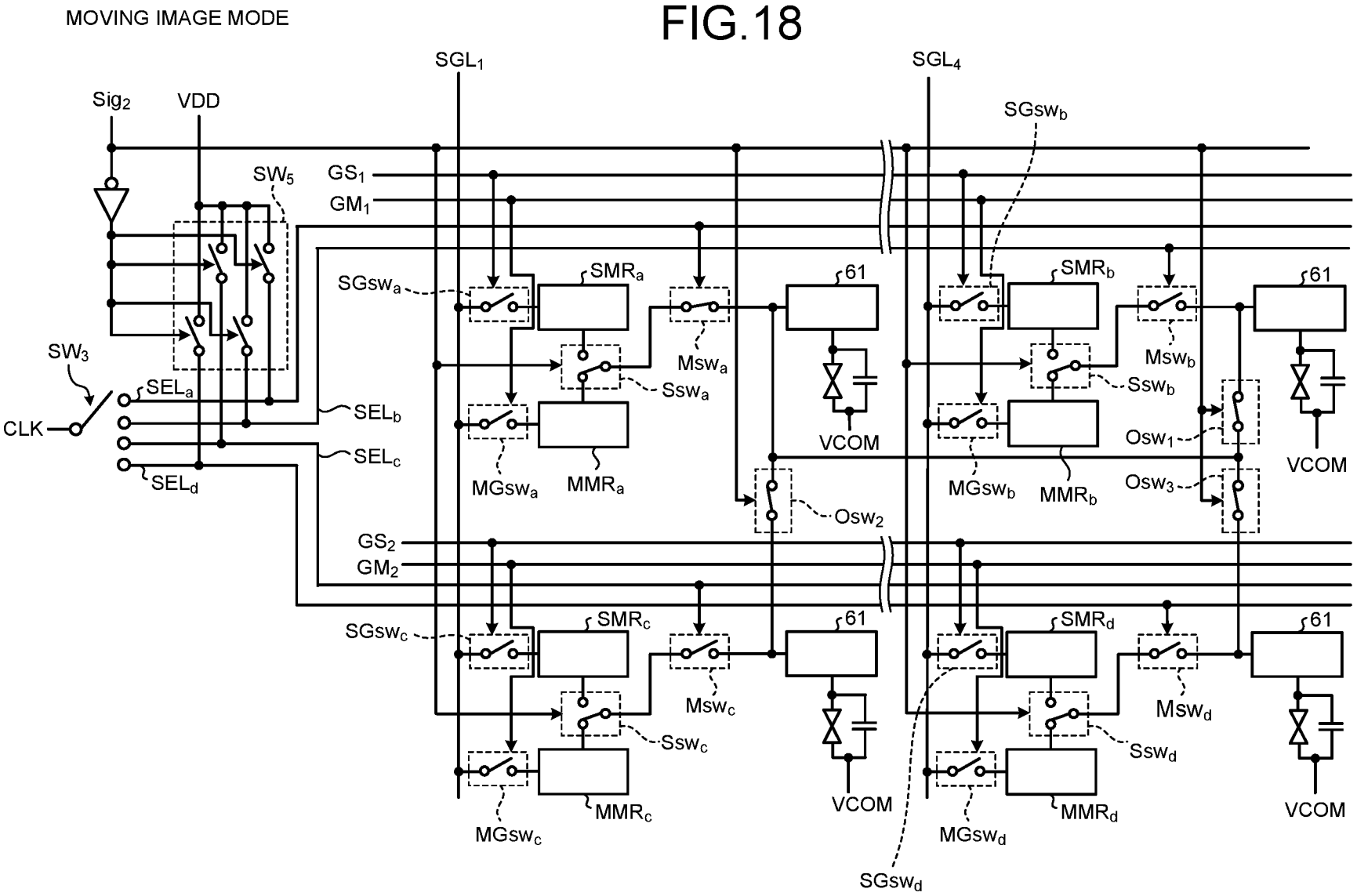
FIG. 18 is a diagram illustrating another circuit configuration of the display device according to the second embodiment.

FIGS. 17 and 18 are diagrams illustrating circuit configurations of the display device according to the second embodiment. FIGS. 17 and 18 illustrate the circuit configurations of the sub-pixels SR of the same color included in the 2×2 pixels Pix and the memories M included in these sub-pixels SR described with reference to FIGS. 14 to 16. The description with reference to FIGS. 17 and 18 describes portions different from those of the first embodiment.

In the configuration included in the sub-pixel $SR_a$, a portion constituted by the switch $Gsw_a$ and the memory $M_a$ in the first embodiment is replaced with a switch $SGsw_a$, a switch $MGsw_a$, the memory $SMR_a$, the memory $MMR_a$, and the switch $Ssw_a$ in the second embodiment. The memory $SMR_a$ is the still image memory M. The memory $MMR_a$ is the moving image memory M. The same description applies to configurations included in the sub-pixels $SR_b$, $SR_c$, and $SR_d$. (by replacing the subscripts).

The gate line $GCL_1$ in the first embodiment is replaced with a gate line $GS_1$ for a still image and a gate line $GM_1$ for a moving image. In the same manner, the gate line $GCL_2$ in the first embodiment is replaced with a gate line $GS_2$ for a still image and a gate line $GM_2$ for a moving image.

The switch $SGsw_a$ opens and closes a path between the source line $SGL_1$ and the memory $SMR_a$. The switch $SGsw_a$ opens or closes depending on whether the gate signal is supplied from the gate line $GS_1$. The switch $MGsw_a$ opens and closes a path between the source line $SGL_1$ and the memory $MMR_a$. The switch $MGsw_a$ opens or closes depending on whether the gate signal is supplied from the gate line $GM_1$.

A switch $SGsw_b$ opens and closes a path between the source line $SGL_4$ and the memory $SMR_b$. The switch $SGsw_b$ opens or closes depending on whether the gate signal is supplied from the gate line $GS_1$. A switch $MGsw_b$ opens and closes a path between the source line $SGL_4$ and the memory $MMR_b$. The switch $MGsw_b$ opens or closes depending on whether the gate signal is supplied from the gate line $GM_1$.

A switch $SGsw_c$ opens and closes a path between the source line $SGL_1$ and the memory $SMR_c$. The switch $SGsw_c$ opens or closes depending on whether the gate signal is supplied from the gate line $GS_2$. A switch $MGsw_c$ opens and closes a path between the source line $SGL_1$ and the memory $MMR_c$. The switch $MGsw_c$ opens or closes depending on whether the gate signal is supplied from the gate line $GM_2$.

A switch $SGsw_d$ opens and closes a path between the source line $SGL_4$ and the memory $SMR_d$. The switch $SGsw_d$ opens or closes depending on whether the gate signal is supplied from the gate line $GS_2$. A switch $MGsw_d$ opens and closes a path between the source line $SGL_4$ and the memory $MMR_d$. The switch $MGsw_d$ opens or closes depending on whether the gate signal is supplied from the gate line $GM_2$.

The difference between the configuration constituted by the memory $M_a$ of the first embodiment and the configuration constituted by the memory $SMR_a$, the memory $MMR_a$, and the switch $Ssw_a$ of the second embodiment is as described above with reference to FIGS. 14 to 16. The same description applies to the configurations included in the sub-pixels $SR_b$, $SR_c$, and $SR_d$ (by replacing the subscripts).

At the time when the sub-pixel data is written to the memory $SMR_a$ and the memory $SMR_b$, the gate signal is output to the gate line $GS_1$. At the time when the sub-pixel data is written to the memory $MMR_a$ and the memory $MMR_b$, the gate signal is output to the gate line $GM_1$. At the time when the sub-pixel data is written to the memory $SMR_c$, and the memory $SMR_d$, the gate signal is output to the gate line $GS_2$. At the time when the sub-pixel data is written to the memory $MMR_c$ and the memory $MMR_d$, the gate signal is output to the gate line $GM_2$.

At the time when the sub-pixel data is written to the memory $SMR_a$, the memory $MMR_a$, the memory $SMR_c$, or the memory $MMR_c$, the sub-pixel data is output to the source line $SGL_1$. At the time when the sub-pixel data is written to the memory $SMR_b$, the memory $MMR_b$, the memory $SMR_d$, or the memory $MMR_d$, the sub-pixel data is output to the source line $SGL_4$.

According to the second embodiment described above, the memories SM for the first mode allow the sub-pixel data corresponding to a still image to continue to be retained in the memories SM. The memories MM for the second mode allow the sub-pixel data corresponding to a moving image to continue to be retained in the memories MM. In other words, the rewriting of the sub-pixel data associated with the mode change can be omitted.

The memories SM may be used in the second mode in the same circuit as that of the second embodiment. This case allows the number of frames of a moving image to be increased to twice that of the sub-pixels S coupled by the switching unit Osw. The number of the memories M included in each of the sub-pixels S may be three or greater. In that case, the switch Ssw serves as a switch that establishes coupling to any one of the memories M included in the sub-pixel S.

Third Embodiment

The following describes a display device according to a third embodiment. In the description of the third embodiment, the same items as those in the first or second embodiment are denoted by the same reference numerals, and will not be described in some cases.

Figure 19:
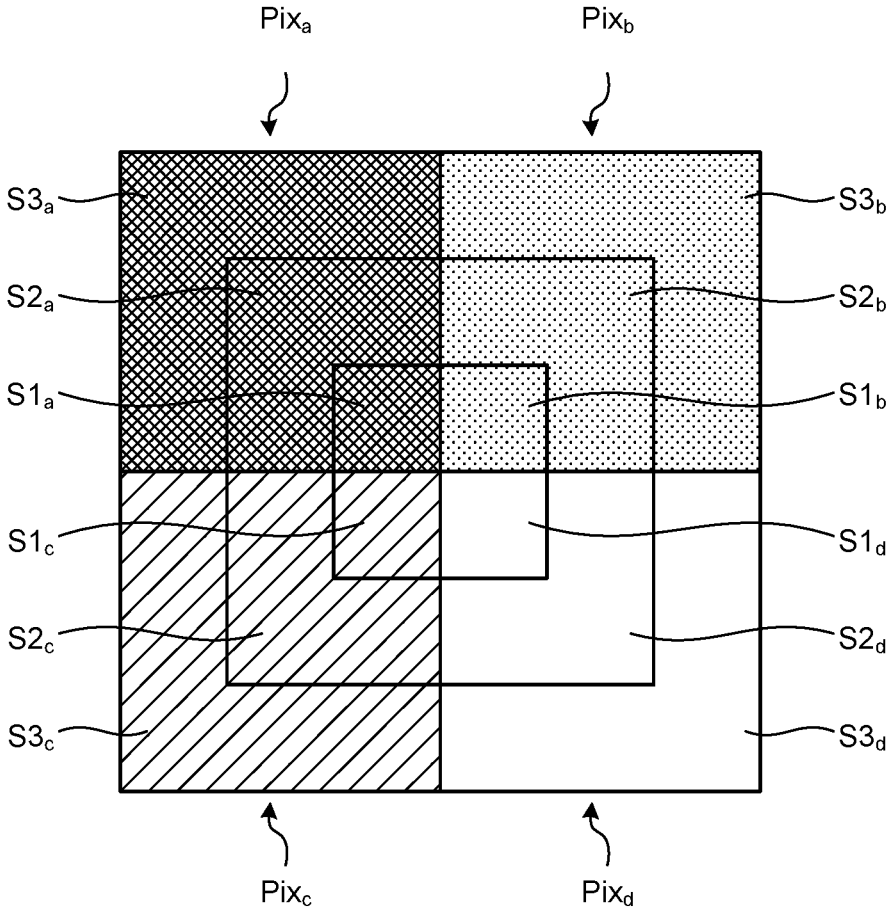
FIG. 19 is a schematic diagram illustrating an example of sub-pixels included in a square pixel to which an area coverage modulation method is applied in a third embodiment.

FIG. 19 is a schematic diagram illustrating an example of sub-pixels included in a square pixel to which an area coverage modulation method is applied in the third embodiment. In the third embodiment, a sub-pixel S1, a sub-pixel S2, and a sub-pixel S3 included in each of the pixels Pix are the sub-pixels S of the same color. For example, a sub-pixel $S1_a$, a sub-pixel $S2_a$, and a sub-pixel $S3_a$ are the red (R)

sub-pixels S; a sub-pixel $S1_b$, a sub-pixel $S2_b$, and a sub-pixel $S3_b$ are the green (G) sub-pixels S; a sub-pixel $S1_c$, a sub-pixel $S2_c$, and a sub-pixel S3 are the blue (B) sub-pixels S; and a sub-pixel $S1_d$, a sub-pixel $S2_d$, and a sub-pixel $S3_d$ are a white (W) sub-pixels S. Each of the sub-pixels $S1_a$ to $S1_d$, each of the sub-pixels $S2_a$ to $S2_d$, and each of the sub-pixels $S3_a$ to $S3_d$ are respectively referred to as the sub-pixel S1, the sub-pixel S2, and the sub-pixel S3 when no distinction is made as to which of the pixels $Pix_a$, $Pix_b$, $Pix_c$, or $Pix_d$ includes the sub-pixels S1, S2, and S3.

The sub-pixels S included in each of the pixels Pix have areas different from one another. For example, the pixel $Pix_a$ includes the sub-pixel $S1_a$, the sub-pixel $S2_a$, and the sub-pixel $S3_a$. The sub-pixel $S2_a$ is larger in area than the sub-pixel $S1_a$. The sub-pixel $S3_a$ is larger in area than the sub-pixel $S2_a$. The same configuration applies to the sub-pixels S included in the pixels $Pix_b$, $Pix_c$, and $Pix_d$ (by replacing the subscripts).

Figure 20:
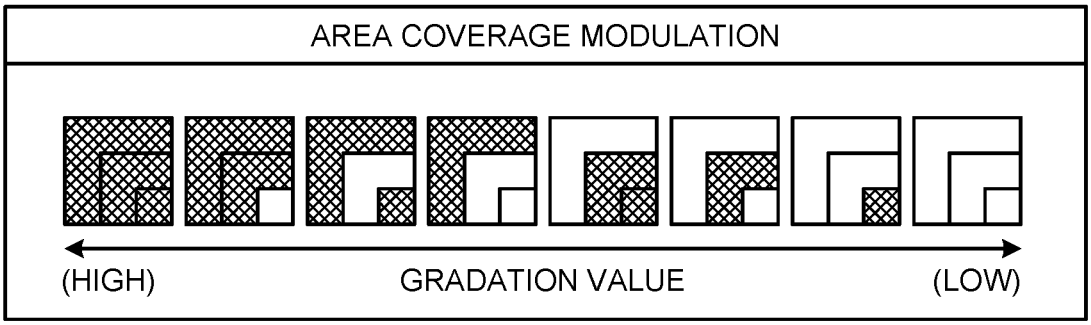
FIG. 20 is an explanatory diagram of the area coverage modulation by a plurality of sub-pixels included in one pixel.

FIG. 20 is an explanatory diagram of the area coverage modulation by the sub-pixels S included in each of the pixels Pix. Of the sub-pixels S included in each of the pixels Pix, some of the sub-pixels S controlled in gradation so as to be luminous are combined with the other sub-pixels S controlled in gradation so as to be non-luminous, and thereby, brightness of the pixel Pix can be adjusted. In other words, multiple gradations can be obtained by the sub-pixels S having areas different from one another. Each of the pixels Pix is configured to provide gradations that can express gradation values represented by bits the number of which corresponds to the number of the sub-pixels S included in the pixel Pix. For example, when the number of the sub-pixels S included in each of the pixels Pix is three, the pixel Pix provides gradations of three bits (eight gradations of 0 to 7), as illustrated in FIG. 20.

Figure 21:
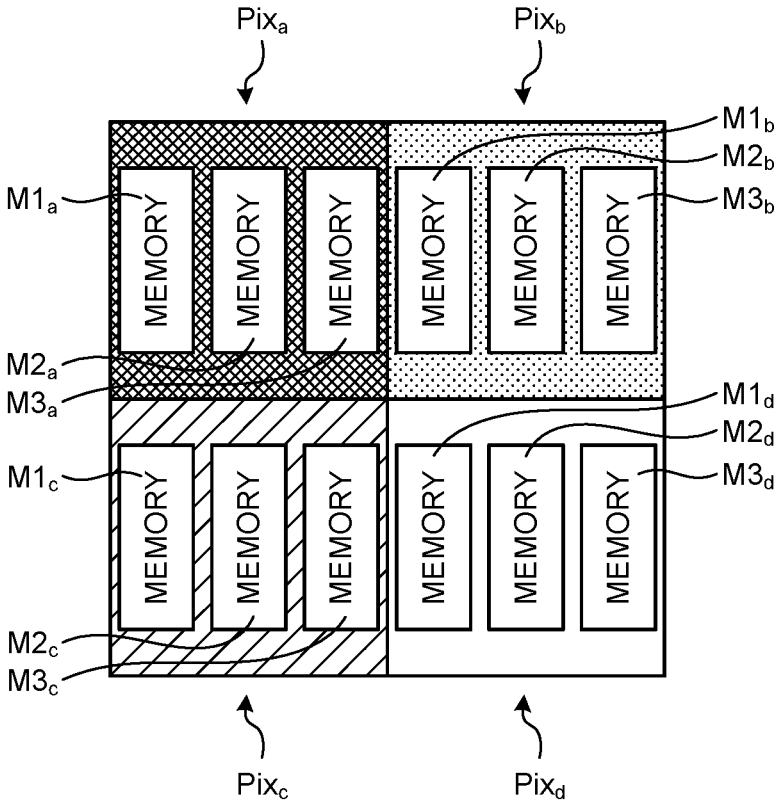
FIG. 21 is a schematic diagram illustrating an example of memories included in the square pixel to which the area coverage modulation method is applied in the third embodiment.

FIG. 21 is a schematic diagram illustrating an example of memories included in the square pixel to which the area coverage modulation method is applied in the third embodiment. Each of the pixels Pix includes the memories M the number of which corresponds to the number of the sub-pixels S included on the pixel Pix. For example, the pixel $Pix_a$ includes three memories M: a memory $M1_a$, a memory $M2_a$, and a memory $M3_a$. The same configuration applies to the pixels $Pix_b$, $Pix_c$, and $Pix_d$ (by replacing the subscripts). The memory $M1_a$, the memory $M2_a$, and the memory $M3_a$ are referred to as a memory M1, a memory M2, and a memory M3 when no distinction is made as to which of the pixels $Pix_a$, $Pix_b$, $Pix_c$, or $Pix_d$ includes the memories M1, M2, and M3.

Figure 22:
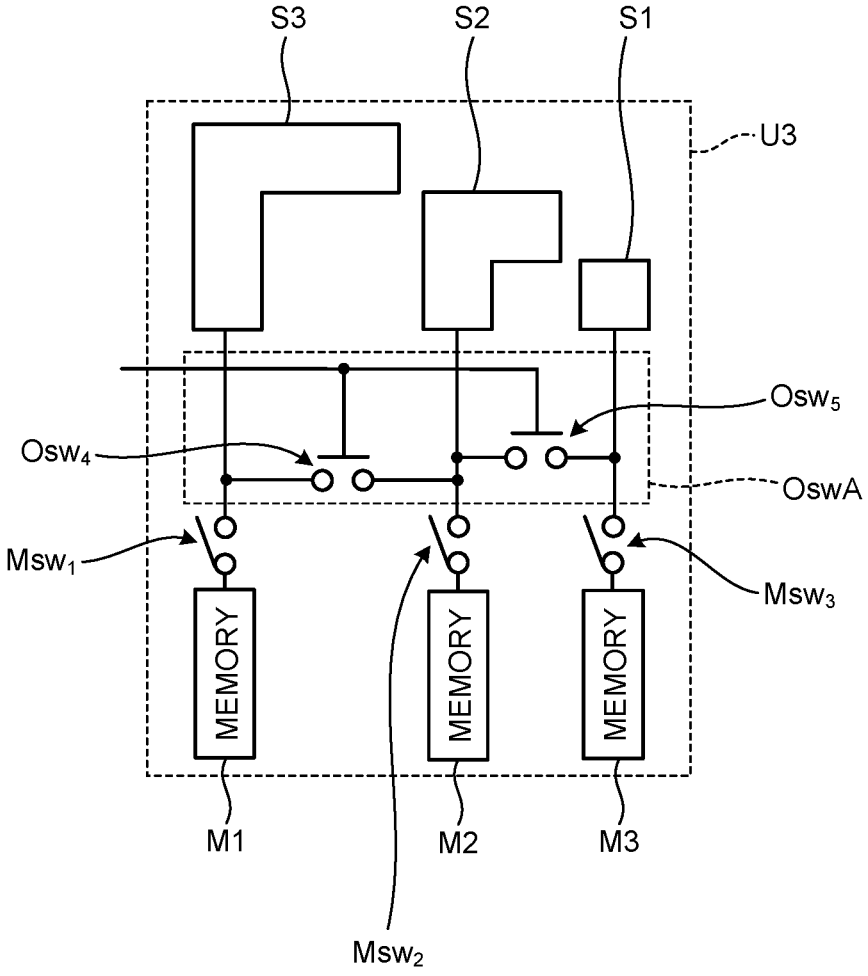
FIG. 22 is a schematic diagram of a circuit including three sub-pixels and three memories included in one pixel in the third embodiment.

FIG. 22 is a schematic diagram of a circuit U3 including the three sub-pixels S and the three memories M included in each of the pixels Pix in the embodiment. The sub-pixel S1, the sub-pixel S2, and the sub-pixel S3 illustrated in FIG. 22 are the sub-pixels S of the same color. These sub-pixels S included in the pixel Pix are provided so as to be capable of being coupled, through a switching unit OswA, to one common memory M out of the memories M (memories M1, M2, and M3) included in the pixel Pix.

The switching unit OswA is coupled to the three sub-pixels S and the three memories M.

The switching unit OswA switches between coupling and uncoupling of wiring between the three sub-pixels S. Specifically, the switching unit OswA includes a switch $Osw_4$ and a switch $Osw_5$. The switch $Osw_4$ opens and closes the wiring between the sub-pixels $S_1$ and $S_2$. The switch $Osw_5$ opens and closes the wiring between the sub-pixels $S_2$ and S3. The switching unit OswA is configured to be coupled to the three memories M through their respective switches. Specifically, the switching unit OswA is configured to be coupled to the memories M1, M2, and M3 through switches $Msw_1$, $Msw_2$, and $Msw_3$, respectively. The switch $Msw_1$ opens and closes wiring between the sub-pixel S1 and the memory M1. The switch $Msw_2$ opens and closes wiring between the sub-pixel S2 and the memory M2. The switch $Msw_3$ opens and closes wiring between the sub-pixel S3 and the memory M3.

Figure 23:
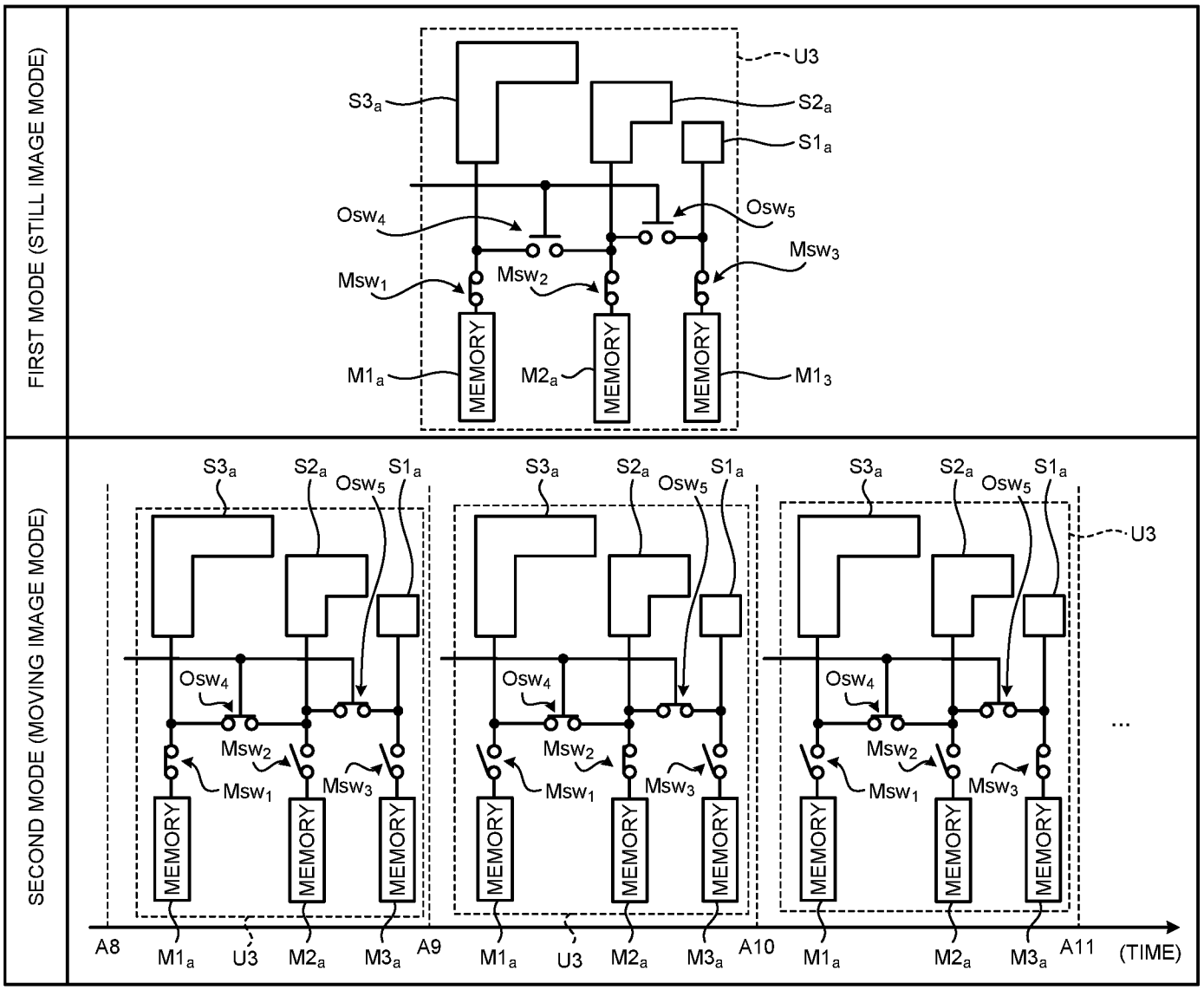
FIG. 23 is a schematic diagram illustrating exemplary coupling configurations in the circuit that differ between the first mode and the second mode in the third embodiment.

FIG. 23 is a schematic diagram illustrating exemplary coupling configurations in the circuit U3 that differ between the first mode and the second mode in the third embodiment. While the description with reference to FIG. 23 exemplifies the configurations included in the pixel $Pix_a$, the same configurations apply to the sub-pixels S included in the pixels $Pix_b$, $Pix_c$, and $Pix_d$ (by replacing the subscripts). In the first mode, the switches $Osw_4$ and $Osw_5$ are opened to be in an uncoupled state, and the switches $Msw_1$, $Msw_2$, and $Msw_3$ are closed to be in a coupled state. As a result, the sub-pixel $S1_a$, the sub-pixel $S2_a$, and the sub-pixel $S3_a$ are coupled to the memory $M1_a$, the memory $M2_a$, and the memory $M3_a$, respectively.

In the second mode, the switches $Osw_4$ and $Osw_5$ are closed to be in a coupled state. Any one of the switches $Msw_1$, $Msw_2$, and $Msw_3$ is closed to be in a coupled state, and the other two thereof are opened to be in an uncoupled state. As a result, the three sub-pixels S: the sub-pixel $S1_a$, the sub-pixel $S2_a$, and the sub-pixel $S3_a$, are coupled to any one of the three memories M: the memory $M1_a$, the memory $M2_a$, and the memory $M3_a$. In the second mode, the memory being coupled to the three sub-pixels $S_a$ is switched according to the timing of switching between the frame images of a moving image. In FIG. 23, the switch $Msw_1$ is closed in a time period of time A8 to A9 in the open/close control of the switches $Msw_1$, $Msw_2$, and $Msw_3$. Accordingly, in the time period of time A8 to A9, the three sub-pixels $S_a$ are subjected to the gradation control according to the sub-pixel data being stored in the memory $M1_a$. Only the switch $Msw_2$ is closed in a time period of time A9 to A10, and only the switch $Msw_3$ is closed between times A10 and A11. The three sub-pixels $S_a$ are subjected to the gradation control according to the sub-pixel data being stored in one of the memories M being coupled thereto in each of the time periods.

The third embodiment exemplifies a case where the numbers of the sub-pixels S and the memories M included in each of the pixels Pix are three. This is, however, merely an example, and the numbers are not limited thereto. The numbers of the sub-pixels S and the memories M included in each of the pixels Pix for the area coverage modulation may be two, or four or more.

The still image memory M and the moving image memory M may be individually provided in the display device of the third embodiment in the same manner as the second embodiment. In that case, only one memory M is required for the still image. In other words, the third embodiment may be provided with memories M, in the sub-pixel, the number of which is obtained by adding one, which is the number of memories for the still image, to the number corresponding to the predetermined number of moving image frames.

According to the third embodiment described above, the sub-pixels having areas different from one another enable the gradation expression based on the area coverage modulation in the first mode.

Modification

The following describes a modification of any one of the embodiments. In the description of the modification, the same items as those in the first, second, or third embodiment are denoted by the same reference numerals, and will not be described in some cases. The modification is applicable to any one of the embodiments (first, second, and third embodiments).

Figure 24:
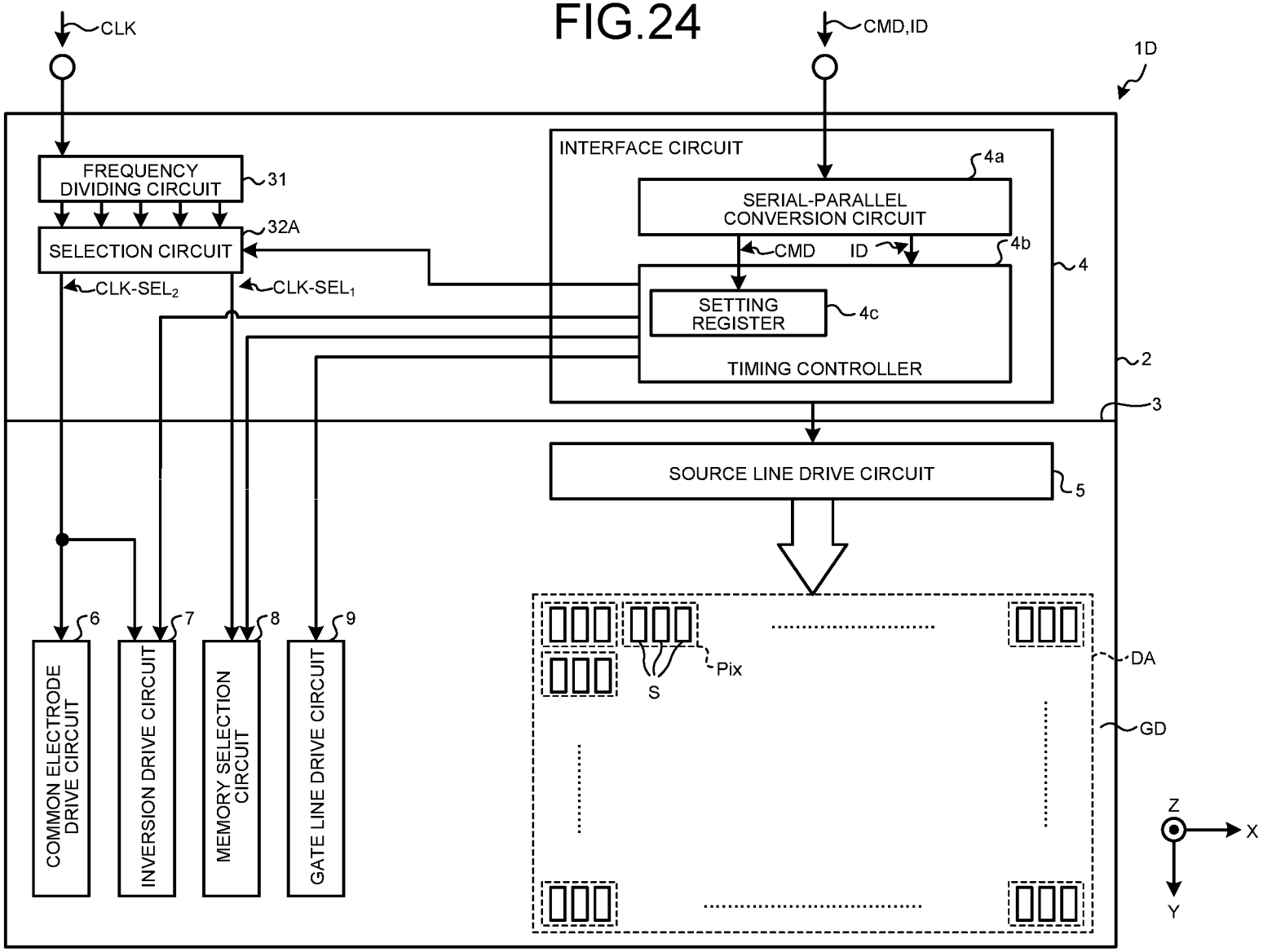
FIG. 24 is a diagram illustrating an overview of an overall configuration of a display device according to a modification.

FIG. 24 is a diagram illustrating an overview of an overall configuration of a display device 1D according to the modification. The display device 1D includes a selection circuit 32A. The timing controller 4*b* controls the selection circuit 32A based on the value set in the setting register 4*c*.

Under the control of the timing controller 4*b*, the selection circuit 32A selects one of a first frequency-divided clock signal CLK-$X_0$ to a fifth frequency-divided clock signal CLK-$X_4$ as a first selected clock signal CLK-$SEL_1$. The selection circuit 32A outputs the first selected clock signal CLK-$SEL_1$ to the memory selection circuit 8. Under the control of the timing controller 4*b*, the selection circuit 32A selects one of the first to fifth frequency-divided clock signals CLK-$X_0$ to CLK-$X_4$ as a second selected clock signal CLK-$SEL_2$. The selection circuit 32A outputs the second selected clock signal CLK-$SEL_2$ to the common electrode drive circuit 6 and the inversion drive circuit 7. The frequency of the first selected clock signal CLK-$SEL_1$ and the frequency of the second selected clock signal CLK-$SEL_2$ may be equal to or different from each other.

Figure 25:
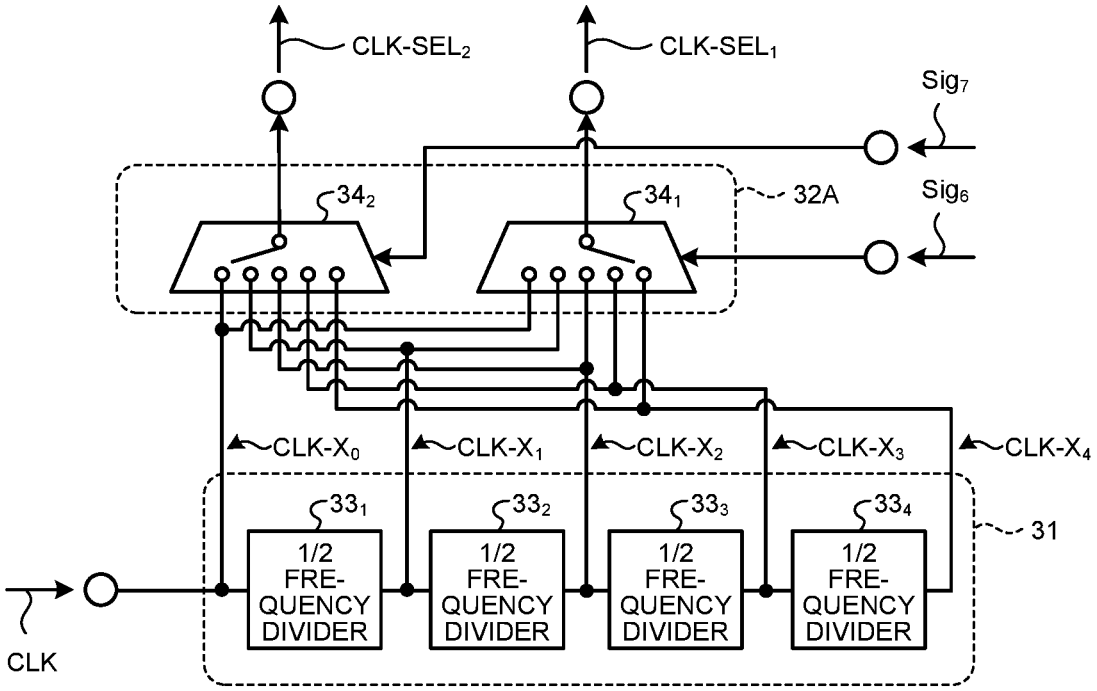
FIG. 25 is a diagram illustrating a circuit configuration of a frequency dividing circuit and a selection circuit of the display device according to the modification.

FIG. 25 is a diagram illustrating a circuit configuration of a frequency dividing circuit and the selection circuit of the display device according to the modification. A frequency dividing circuit 31 includes a first ½ frequency divider $\mathbf{33}_1$ to a fourth ½ frequency divider $\mathbf{33}_4$ that are daisy-chained. The selection circuit 32A includes a first selector $\mathbf{34}_1$ and a second selector $\mathbf{34}_2$.

The first selector $\mathbf{34}_1$ is supplied with the first to fifth frequency-divided clock signals CLK-$X_0$ to CLK-$X_4$. The first selector $\mathbf{34}_1$ selects one frequency-divided clock signal, as the first selected clock signal CLK-$SEL_1$, out of the first to fifth frequency-divided clock signals CLK-$X_0$ to CLK-$X_4$ based on a control signal Sigh supplied from the timing controller 4*b*. The first selector $\mathbf{34}_1$ outputs the first selected clock signal CLK-$SEL_1$ to the memory selection circuit 8.

The second selector $\mathbf{34}_2$ is supplied with the first to fifth frequency-divided clock signals CLK-$X_0$ to CLK-$X_4$. The second selector $\mathbf{34}_2$ selects one frequency-divided clock signal, as the second selected clock signal CLK-$SEL_2$, out of the first to fifth frequency-divided clock signals CLK-$X_0$ to CLK-$X_4$ based on a control signal $Sig_7$ supplied from the timing controller 4*b*. The second selector $\mathbf{34}_2$ outputs the second selected clock signal CLK-$SEL_2$ to the common electrode drive circuit 6 and the inversion drive circuit 7.

Figure 26:
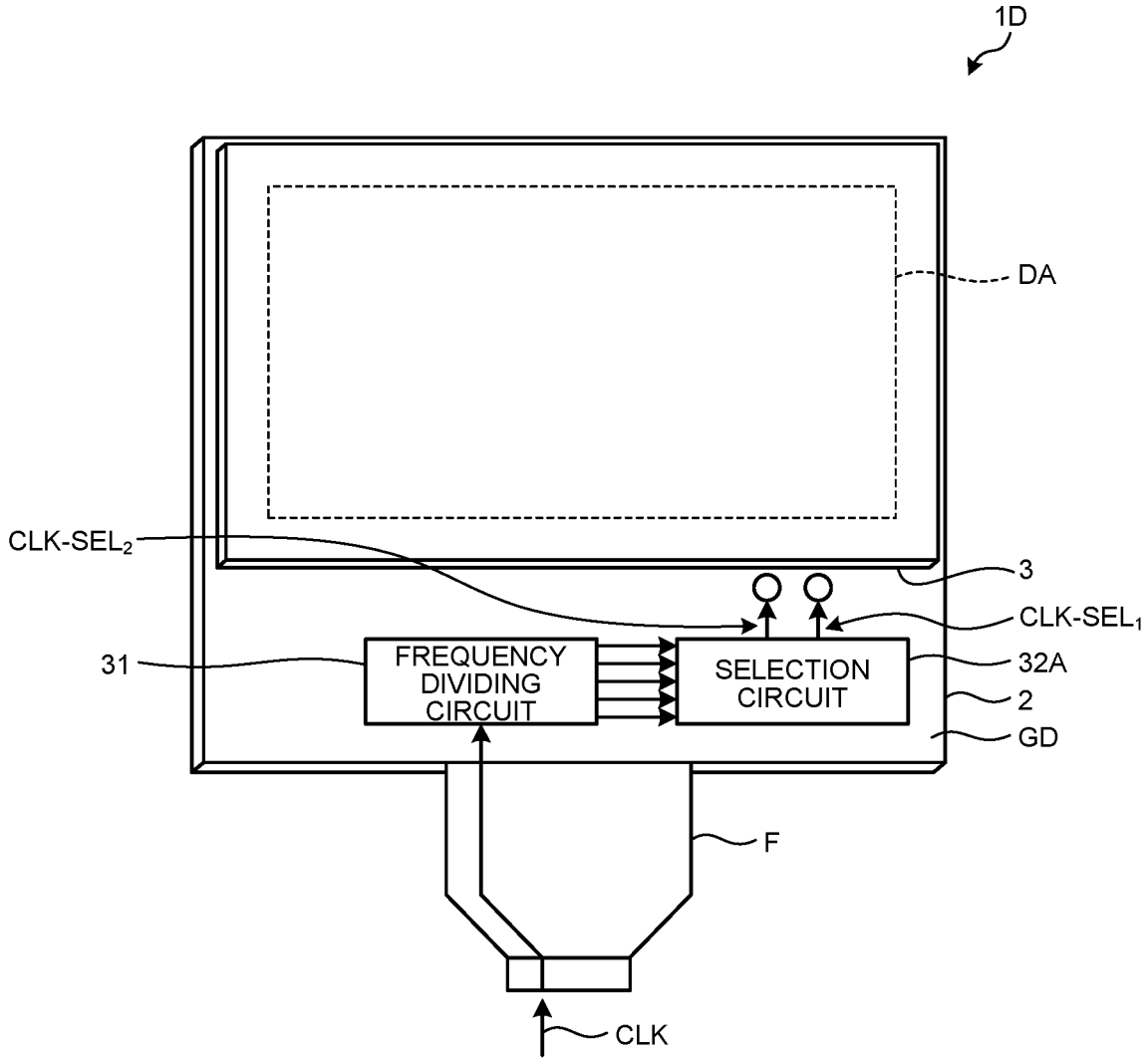
FIG. 26 is a diagram illustrating a module configuration of the display device according to the modification.

FIG. 26 is a diagram illustrating a module configuration of the display device according to the modification. In detail, FIG. 26 is a diagram illustrating an arrangement of the frequency dividing circuit 31 and the selection circuit 32A in the display device 1D. The frequency dividing circuit 31 and the selection circuit 32A are disposed at a portion in the frame area GD where the first panel 2 does not overlap the second panel 3. A flexible substrate F is attached to the first panel 2. The reference clock signal CLK is supplied to the frequency dividing circuit 31 through the flexible substrate F.

The frequency dividing circuit 31 outputs, to the selection circuit 32A, the first to fifth frequency-divided clock signals CLK-$X_0$ to CLK-$X_4$ obtained by dividing the frequency of the reference clock signal CLK. The selection circuit 32A selects one frequency-divided clock signal, as the first selected clock signal CLK-$SEL_1$, out of the first to fifth frequency-divided clock signals CLK-$X_0$ to CLK-$X_4$. The selection circuit 32A outputs the first selected clock signal CLK-$SEL_1$ to the memory selection circuit 8. The selection circuit 32A selects one of the first to fifth frequency-divided clock signals CLK-$X_0$ to CLK-$X_4$ as the second selected clock signal CLK-$SEL_2$. The selection circuit 32A outputs the second selected clock signal CLK-$SEL_2$ to the common electrode drive circuit 6 and the inversion drive circuit 7.

The frequency dividing circuit 31 and the selection circuit 32A may be mounted on the first panel 2 as a chip-on-glass (COG) module. The frequency dividing circuit 31 and the selection circuit 32A may alternatively be mounted on the flexible substrate F as the chip-on-film (COF) module.

Figure 27:
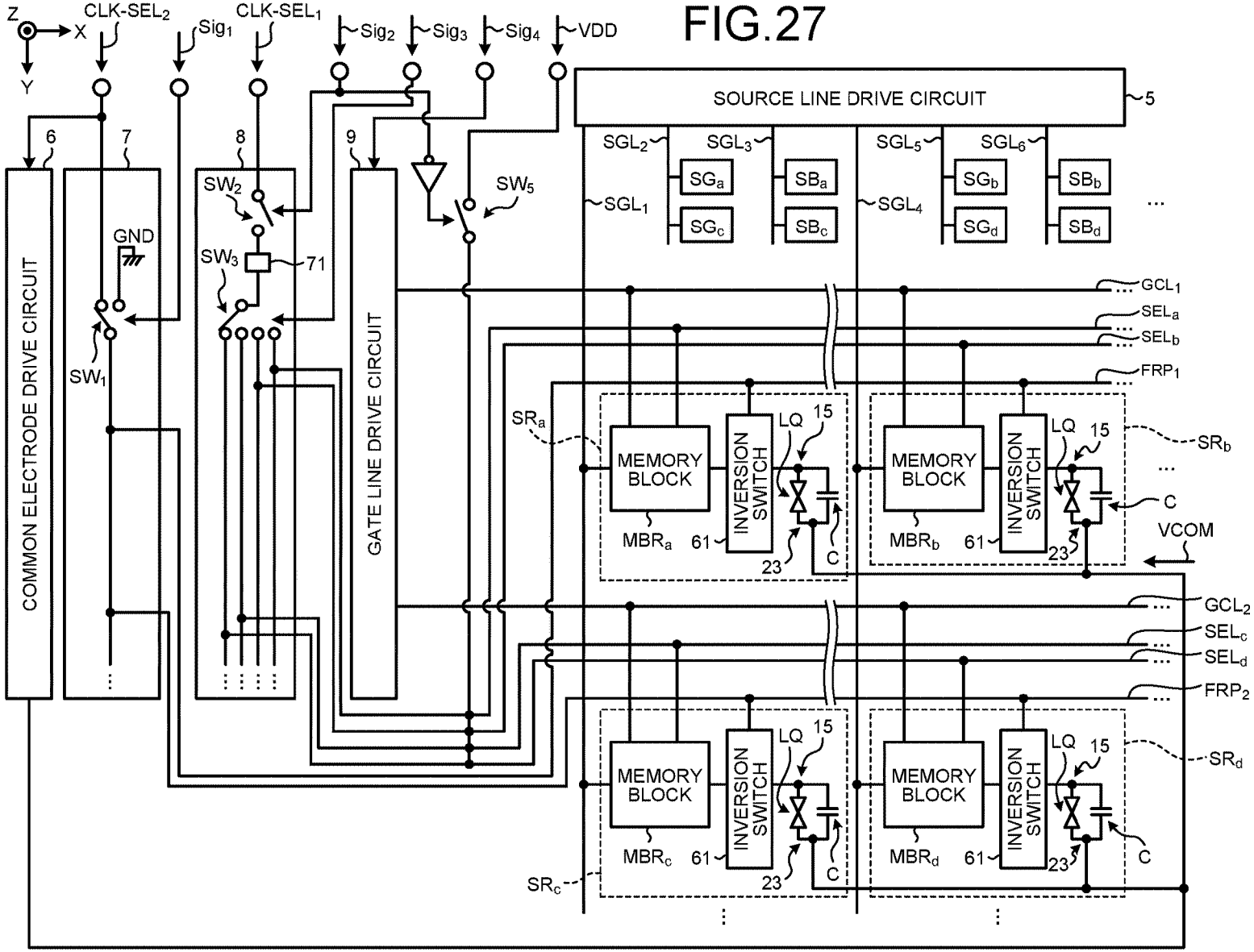
FIG. 27 is a diagram illustrating a circuit configuration of the display device according to the modification.

FIG. 27 is a diagram illustrating a circuit configuration of the display device according to the modification. The reference clock signal CLK supplied to the common electrode drive circuit 6 and the inversion drive circuit 7 in the embodiments is replaced with the second selected clock signal CLK-$SEL_2$ in the modification. The reference clock signal CLK supplied to the memory selection circuit 8 in the embodiments is replaced with the first selected clock signal CLK-$SEL_1$ in the modification.

Figure 28:
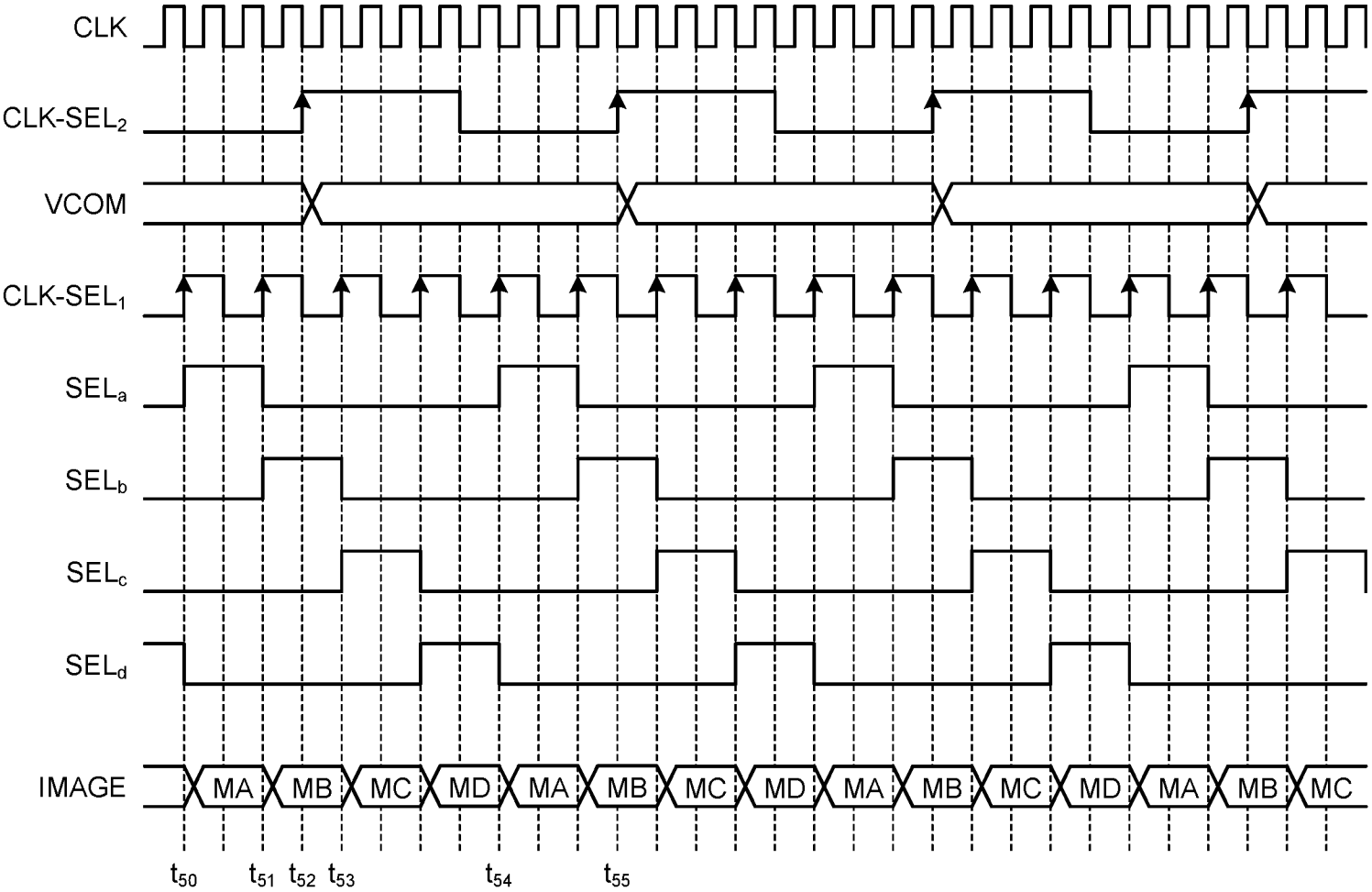
FIG. 28 is a timing diagram illustrating an operation timing example of the display device according to the modification.

FIG. 28 is a timing diagram illustrating an operation timing example of the display device according to the modification. FIG. 28 illustrates the second mode. The timing controller 4*b* outputs, to the first selector $\mathbf{34}_1$, the control signal Sigh for selecting the second frequency-divided clock signal CLK-Xi based on the value of the setting register 4*c*. This operation causes the first selector $\mathbf{34}_1$ to select the second frequency-divided clock signal CLK-Xi as the first selected clock signal CLK-SELL Thus, the frequency of the first selected clock signal CLK-$SEL_1$ is ½ times the frequency of the reference clock signal CLK. The first selector $\mathbf{34}_1$ outputs the first selected clock signal CLK-$SEL_1$ to the memory selection circuit 8.

The timing controller 4*b* outputs, to the second selector $\mathbf{34}_2$, the control signal $Sig_7$ for selecting the fourth frequency-divided clock signal CLK-$X_3$ based on the value of the setting register 4*c*. This operation causes the second selector $\mathbf{34}_2$ to select the fourth frequency-divided clock signal CLK-$X_3$ as the second selected clock signal CLK-$SEL_2$. Thus, the frequency of the second selected clock signal CLK-$SEL_2$ is ⅛ times the frequency of the reference clock signal CLK. The second selector $\mathbf{34}_2$ outputs the second selected clock signal CLK-$SEL_2$ to the common electrode drive circuit 6 and the inversion drive circuit 7. The common electrode drive circuit 6 supplies, to the common electrode 23, the common potential VCOM that is inverted in synchronization with the first selected clock signal CLK-SELL From time $t_{50}$ to time $t_{54}$, four frame images corresponding to the moving image sub-pixel data MA, MB, MC, and MD are sequentially switched. Also at later times, the frame images are sequentially switched at intervals of the same period.

At time $t_{55}$, the second selected clock signal CLK-$SEL_2$ changes from a low level to a high level. This signal change causes the common electrode drive circuit 6 to invert the common potential VCOM of the common electrode 23 at time $t_{55}$. The operation of the common electrode drive circuit 6 after time $t_{55}$ is the same as the operation thereof from time $t_{52}$ to time $t_{55}$, and therefore, will not be described. In this manner, the frequency dividing circuit 31 and the selection circuit 32A can individually control the switching period of the frame images and the switching period of the inversion driving of the sub-pixel potential.

The individual timing control by use of the frequency dividing circuit 31 and the selection circuit 32A is not limited to the switching period of the frame images and the switching period of the inversion driving of the sub-pixel potential. For example, the period of the replacement of the sub-pixel data being stored in the memory M and the switching period of the frame images may be individually controlled.

APPLICATION EXAMPLE

Figure 29:
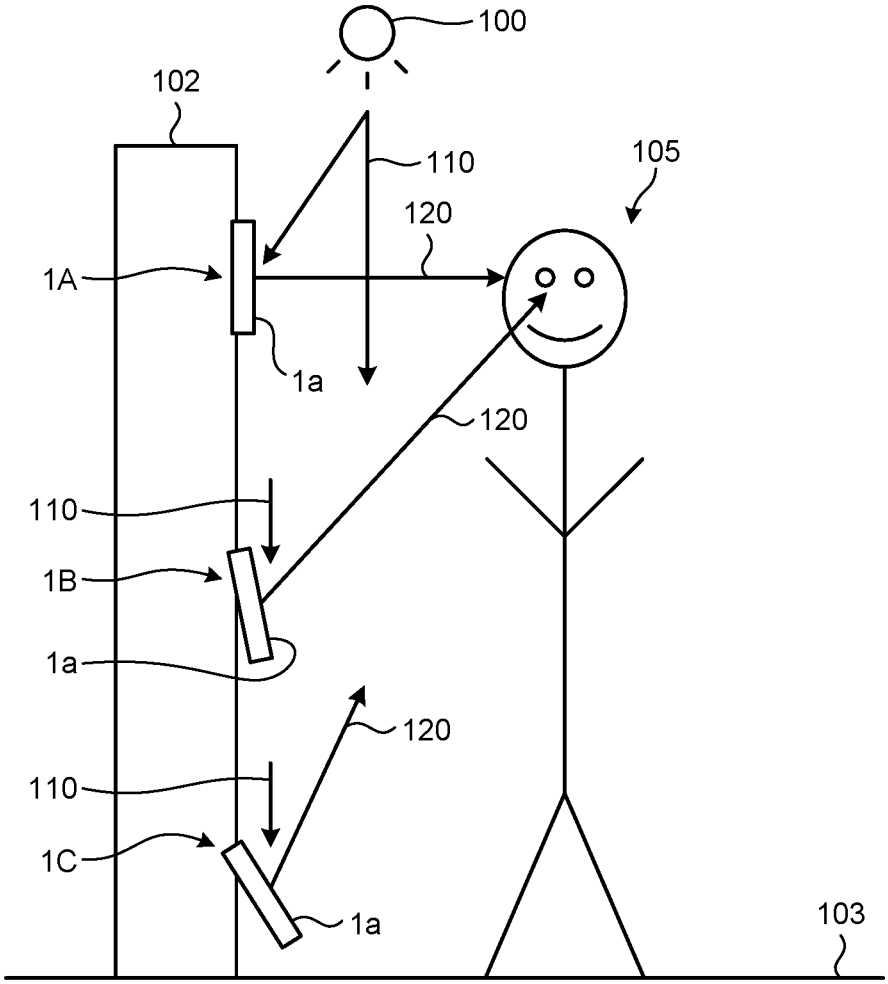
FIG. 29 is a diagram illustrating an application example of the display device according to any one of the embodiments.

FIG. 29 is a diagram illustrating an application example of the display device according to any one of the embodiments. FIG. 29 is a diagram illustrating an example in which the display device is applied to electronic shelf labels according to any one of the embodiments or the modification.

As illustrated in FIG. 29, display devices 1A, 1B, and 1C are mounted on shelving 102. Each of the display devices 1A, 1B, and 1C has the same configuration as that of the display device described above according to any one of the embodiments or the modification. The display devices 1A, 1B, and 1C are mounted at different heights from a floor surface 103, and mounted so as to have different panel inclination angles. The panel inclination angle is an angle formed between the normal line to the display surface 1*a* and the horizontal direction. The display devices 1A, 1B, and 1C reflect incident light 110 from a lighting device 100 serving as a light source to output an image 120 toward a viewer 105.

The preferred embodiments of the present invention have been described above. The present invention is, however, not limited to the embodiments described above. The content disclosed in the embodiments is merely an example, and can be variously modified within the scope not departing from the gist of the present invention. Any modifications appropriately made within the scope not departing from the gist of the present invention also naturally belong to the technical scope of the present invention. At least one of various omissions, replacements, and modifications of the components can be made without departing from the gist of the embodiments and the modification described above.

What is claimed is:

1. A display device comprising:

a plurality of sub-pixels, each sub-pixel including
- a pixel electrode,
- at least one memory, and
- an inversion switch that provides display signals to the pixel electrode based on an output from the memory;

a setting circuit configured to select either a first mode in which a still image is displayed or a second mode in which a moving image is displayed; and a switching circuit including a switching unit that is provided between the inversion switches and the memories of the sub-pixels, the switching circuit being configured to switch coupling between the inversion switches and the memories according to the selection made by the setting circuit, wherein the first mode is a mode in which each of the inversion switches in one of the sub-pixels is coupled to the at least one memory in the one of the sub-pixels, and the second mode is a mode including a time period in which at least the inversion switch in one of the sub-pixels is coupled to the at least one memory in another one of the sub-pixels.

2. The display device according to claim 1, wherein the switching circuit includes the switching unit configured to open and close paths for coupling the at least the inversion switch in the one of the sub-pixels to the at least one memory in the other of the sub-pixels in the second mode.

3. The display device according to claim 2, wherein the switching circuit includes a plurality of switches configured to individually open and close paths between the inversion switch of the sub-pixels and the memories included in the sub-pixels, and the switches are configured such that, in the second mode, one of the switches closes the path between the at least one of the inversion switches in the one of the sub-pixels and the at least one memory included in the other of the sub-pixels.

4. The display device according to claim 1, wherein the second mode is a mode in which a predetermined number of the inversion switches of the sub-pixels are coupled to one of the memories included in the predetermined number of the sub-pixels, and the memory being coupled to the predetermined number of the inversion switches of the sub-pixels is switched at predetermined intervals of time, the predetermined number is two or greater, and when the display device operates in the second mode, the memories included in the predetermined number of the sub-pixels retain different pieces of data corresponding to different frame images constituting the moving image that is displayed by switching a frame image among the different frame images.

5. The display device according to claim 4, comprising a plurality of pixels, wherein each of the pixels includes two or more of the sub-pixels having different colors, and the predetermined number of the sub-pixels are the sub-pixels having the same color included in the predetermined number of the pixels.

6. The display device according to claim 4, further comprising a pixel including the predetermined number of the sub-pixels having areas, and the areas of the pixel electrodes in the pixel are different from one another.

7. The display device according to claim 1, wherein the at least one memory comprises a plurality of memories including a memory for the first mode and a memory for the second mode.

8. A display device comprising:

a first sub-pixel including
- a first sub-pixel electrode,
- a first memory, and
- a first inversion switch that provides display signals to the pixel electrode based on an output from the first memory;

a second sub-pixel including
- a second sub-pixel electrode,
- a second memory, and
- a second inversion switch that provides display signals to the pixel electrode based on an output from the first memory;

a setting circuit configured to select either
- a first mode in which a still image is displayed by the first sub-pixel and the second sub-pixel or
- a second mode in which a moving image is displayed by the first sub-pixel and the second sub-pixel; and a switching circuit configured to switch coupling between the inversion switches and the first and second memories according to the selection of the setting circuit, wherein the first mode is a mode in which the first inversion switch is coupled to the first memory, and the second inversion switch is coupled to the second memory, and the second mode is a mode including a time period in which at least the second inversion switch is coupled to the first memory.

9. The display device according to claim 8, wherein the switching circuit includes a switching unit configured to open and close paths for coupling the first inversion switch and the second inversion switch to the first memory.

10. The display device according to claim 9, wherein the switching circuit includes a first switching unit configured to open and close a path between the first inversion switch and the first memory, and a second switching unit configured to open and close a path between the second inversion switch and the second memory, the switching unit is interposed between a first node that couples the first memory to the first inversion switch and a second node that couples the second memory to the second inversion switch, and the switching unit is configured to:

uncouple the first node from the second node in the first mode; and couple the first node to the second node in the second mode.

11. The display device according to claim 10, comprising a first pixel and a second pixel, wherein the first pixel includes the first sub-pixel and another sub-pixel having a color different from that of the first sub-pixel, the second pixel includes the second sub-pixel and still another sub-pixel having a color different from that of the second sub-pixel, and the first sub-pixel and the second sub-pixel have the same color.

12. The display device according to claim 8, wherein the memories include a memory for a still image serving for the first mode and a memory for a moving image serving for the second mode.

* * * * *